US008066143B2

(12) United States Patent
Baltz et al.

(10) Patent No.: US 8,066,143 B2
(45) Date of Patent: Nov. 29, 2011

(54) STORAGE CONTAINER WITH HINGED LID

(75) Inventors: Kyle L. Baltz, Redondo Beach, CA (US); William J. Rehrig, Rancho Palos Verdes, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 839 days.

(21) Appl. No.: 11/358,695

(22) Filed: Feb. 21, 2006

(65) Prior Publication Data

US 2006/0186123 A1 Aug. 24, 2006

Related U.S. Application Data

(60) Provisional application No. 60/655,834, filed on Feb. 22, 2005.

(51) Int. Cl.
*B65D 45/16* (2006.01)
*B65D 51/04* (2006.01)

(52) U.S. Cl. ..... 220/324; 220/826

(58) Field of Classification Search ..... 220/735, 220/527, 844, 843, 254.6, 254.3, 254.2, 254.1, 220/FOR. 203, FOR. 201, FOR. 200, FOR. 196, 220/FOR. 195, FOR. 192, 200; D3/303; 383/40; D9/423, 421, 420, 414, 424, 435, D9/434; 190/102, 101, 120, 19, 112, 902, 190/900, 100, 119, 114; 40/312, 6; *B65D 43/16, B65D 25/20, 43/14, 43/00*

See application file for complete search history.

(56) References Cited

U.S. PATENT DOCUMENTS

| | | | | | |
|---|---|---|---|---|---|
| 1,026,649 | A | * | 5/1912 | Beshore | 70/161 |
| 1,047,343 | A | * | 12/1912 | Vaughn | 190/16 |
| 1,102,556 | A | * | 7/1914 | Swartz | 16/308 |
| 1,178,773 | A | * | 4/1916 | Adams | 68/238 |
| 1,547,662 | A | * | 7/1925 | Miniere | 220/324 |
| 1,610,354 | A | * | 12/1926 | Brown | 40/653 |
| 1,671,051 | A | * | 5/1928 | Soderquist | 220/6 |
| 1,742,075 | A | * | 12/1929 | Houghten | 220/810 |
| 1,767,573 | A | * | 6/1930 | Braunstein | 40/653 |
| 2,158,972 | A | * | 5/1939 | Weindel, Jr. | 220/62 |
| 2,275,373 | A | * | 3/1942 | Barrett | 312/300 |
| 2,347,980 | A | * | 5/1944 | Apfelbaum | 220/844 |

(Continued)

FOREIGN PATENT DOCUMENTS

EP 0 119 677 9/1984

(Continued)

OTHER PUBLICATIONS

United Kingdom Search Report and Opinion, Jun. 29, 2006.

*Primary Examiner* — Anthony Stashick
*Assistant Examiner* — Robert J Hicks
(74) *Attorney, Agent, or Firm* — Carlson, Gaskey & Olds

(57) ABSTRACT

A storage container includes a base having side walls and end walls extending upwardly from the base. Lid halves are hingeably connected to upper edges of the side walls. A security recess is formed in the side walls adjacent to each hinge and corresponds with a security tab projecting from the lid halves preventing vertical movement of the outer edge of the lid half when the lid is in the closed position. The lid halves also include a lip adjacent to the hinge and upper and lower leaves that overlap with the opposing lid half to prevent moisture from seeping into the storage container.

64 Claims, 21 Drawing Sheets

U.S. PATENT DOCUMENTS

| | | | | | |
|---|---|---|---|---|---|
| 2,505,898 | A | * | 5/1950 | Jaffe et al. | 190/12 R |
| 2,549,545 | A | * | 4/1951 | Thibieroz | 312/221 |
| D191,924 | S | * | 12/1961 | Meade et al. | D3/303 |
| 3,338,464 | A | * | 8/1967 | Callihan et al. | 206/309 |
| 3,463,345 | A | * | 8/1969 | Bockenstette | 220/826 |
| 3,754,676 | A | * | 8/1973 | Box | 220/324 |
| 3,874,435 | A | * | 4/1975 | Allen | 383/29 |
| 4,105,112 | A | * | 8/1978 | Graf | 206/1.5 |
| 4,154,362 | A | | 5/1979 | McKenney | |
| 4,161,261 | A | | 7/1979 | Frater | |
| D252,596 | S | * | 8/1979 | Adler et al. | D3/319 |
| 4,364,489 | A | | 12/1982 | Alexeeff | |
| 4,432,467 | A | | 2/1984 | Swingley | |
| 4,523,692 | A | | 6/1985 | Lemkin | |
| 4,572,368 | A | | 2/1986 | Miller | |
| 4,620,644 | A | | 11/1986 | Miller | |
| 4,663,803 | A | * | 5/1987 | Gora | 16/266 |
| 4,685,567 | A | | 8/1987 | Webb | |
| 4,741,433 | A | * | 5/1988 | Irvine | 206/1.5 |
| 4,746,008 | A | * | 5/1988 | Heverly et al. | 206/1.5 |
| 4,765,480 | A | | 8/1988 | Malmanger | |
| 4,863,062 | A | * | 9/1989 | Holliday | 220/845 |
| 4,944,422 | A | * | 7/1990 | Aurness et al. | 220/500 |
| RE33,384 | E | | 10/1990 | Miller | |
| D319,904 | S | * | 9/1991 | Cozzi et al. | D34/1 |
| 5,051,725 | A | * | 9/1991 | Caccitolo | 340/571 |
| 5,131,513 | A | * | 7/1992 | Gossage | 190/107 |
| 5,250,981 | A | * | 10/1993 | Greene | 355/76 |
| 5,328,048 | A | | 7/1994 | Stein | |
| 5,330,069 | A | | 7/1994 | Jamison | |
| 5,353,948 | A | | 10/1994 | Lanoue | |
| 5,360,114 | A | | 11/1994 | Weidt | |
| 5,433,929 | A | * | 7/1995 | Riihimaki et al. | 422/297 |
| 5,474,200 | A | | 12/1995 | Nicholson | |
| 5,524,750 | A | | 6/1996 | Miller | |
| 5,673,791 | A | | 10/1997 | Jamison | |
| 5,678,693 | A | * | 10/1997 | Tapp et al. | 206/454 |
| 5,832,543 | A | * | 11/1998 | Bosserman | 4/259 |
| 5,860,527 | A | | 1/1999 | Frankenberg | |
| 6,000,576 | A | | 12/1999 | Liu | |
| 6,250,490 | B1 | | 6/2001 | Loftus | |
| 6,276,530 | B1 | | 8/2001 | Bailey | |
| 6,315,154 | B1 | * | 11/2001 | Newby | 220/844 |
| 6,318,586 | B1 | | 11/2001 | Frankenberg | |
| 6,431,394 | B2 | | 8/2002 | Frankenberg | |
| D493,282 | S | | 7/2004 | Dubois | |
| 2002/0008114 | A1 | * | 1/2002 | Frankenberg | 220/826 |
| 2002/0073984 | A1 | * | 6/2002 | Ahn | 126/33 |
| 2002/0162842 | A1 | * | 11/2002 | Pangerc et al. | 220/524 |
| 2004/0000030 | A1 | * | 1/2004 | Pleiman et al. | 16/267 |
| 2004/0083578 | A1 | * | 5/2004 | Rader | 16/380 |
| 2004/0118716 | A1 | | 6/2004 | Watson et al. | |
| 2004/0144793 | A1 | * | 7/2004 | Lessard et al. | 220/836 |
| 2004/0182872 | A1 | * | 9/2004 | Lessard et al. | 220/826 |
| 2006/0091145 | A1 | * | 5/2006 | Miller et al. | 220/826 |

FOREIGN PATENT DOCUMENTS

| | | | | |
|---|---|---|---|---|
| EP | 0356322 | | | 2/1990 |
| EP | 1 013 561 | | | 6/2000 |
| EP | 1 013 561 | A2 | | 6/2000 |
| EP | 1 186 542 | | | 3/2002 |
| EP | 1 186 542 | A1 | | 3/2002 |
| EP | 1 190 955 | | | 3/2002 |
| GB | 1381068 | | | 3/1973 |
| GB | 2323589 | A | | 9/1998 |
| GB | 2 349 868 | | | 11/2000 |
| GB | 2 368 337 | | | 5/2002 |
| JP | 54002859 | A | * | 1/1979 |
| JP | 04307012 | A | * | 10/1992 |
| JP | 10324354 | A | * | 12/1998 |
| JP | 2003276736 | A | * | 10/2003 |
| JP | 2006096415 | A | * | 4/2006 |
| JP | 2006178638 | A | * | 7/2006 |
| WO | WO 03/095320 | A1 | | 11/2003 |

* cited by examiner

STORAGE CONTAINER WITH HINGED LID

This application claims priority to U.S. Provisional Application Ser. No. 60/655,834 filed Feb. 22, 2005.

BACKGROUND OF THE INVENTION

This invention relates to a storage container and more particularly to a storage container with improved tamper-resistant features.

Known portable storage containers include two end walls and two side walls extending upwardly from the periphery of a base. Lid halves are each hingeably connected to an upper edge of one of the side walls. Apertures in the overlapping edges of the lid halves are aligned with one another and with apertures through the upper edges of the end walls. Locks through the apertures secure the container closed. Overlapping, interlocking leaves at inner edges of the lid halves prevent intrusion between the lid halves.

In some known containers, it is possible to disassemble the hinged connection of the lid halves to the side walls. Therefore, even though the inner edges of the lid halves are secured, the container can be accessed by unauthorized people. Additionally, in the known containers, moisture can seep between the interlocking leaves between the lid halves.

SUMMARY OF THE INVENTION

An example storage container according to the present invention includes a base having side walls and end walls extending upwardly from the base. Lid halves are hingeably connected to upper edges of the side walls. The upper surface of the lid halves includes a lip along the outer edge adjacent the hinge to prevent moisture from seeping into the storage container between the lid halves and the hinges.

Stops project upwardly from each lid half above the end walls and recesses within the end walls adjacent the base align with the stops, such that stops would be received within the recesses of an adjacent container to increase the stability of a stack of containers.

A security recess is formed on an inner surface of the side walls adjacent to each hinge. Each security recess is aligned with a corresponding security tab projecting from the lid halves. When the lid is in the closed position, each security tab is received in a security recess, thus preventing vertical movement of the outer edge of the lid half.

The inner edge of each lid half includes upper and lower leaves that overlap with upper and lower leaves on the opposing lid half. The lower leaves each include a plurality of protrusions behind a lip extending upwardly from the lower leaf. The lip helps prevent any moisture that seeps between the lid halves from entering the container.

One of the lid halves includes a pocket for holding an identification ticket for shipping the storage container. The pocket includes a recess adjacent an opening to the pocket to assist in grasping the ticket more easily.

Each lid half includes an upward projection for contacting the wall adjacent a recess when the lid half is partially closed. The projection provides sufficient interference to keep the lid partially open under its own weight, but can easily be overcome by pressing down on the lid half.

These and other features of the present invention can be best understood from the following specification and drawings, the following of which is a brief description.

DETAILED DESCRIPTION OF THE PREFERRED EMBODIMENTS

Figure 1:
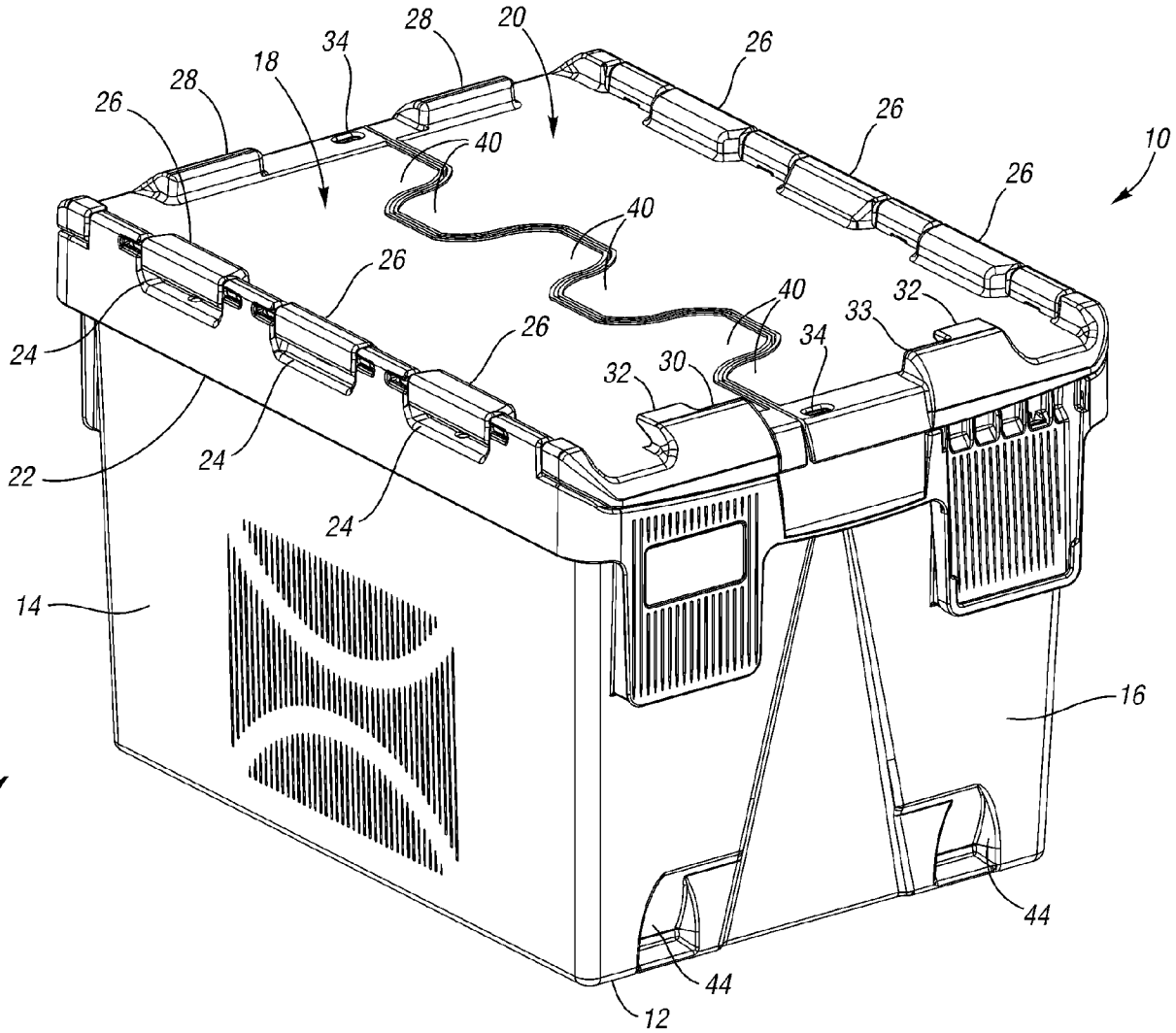
FIG. 1 is a front perspective view of an example storage container of the present invention.
Figure 2:
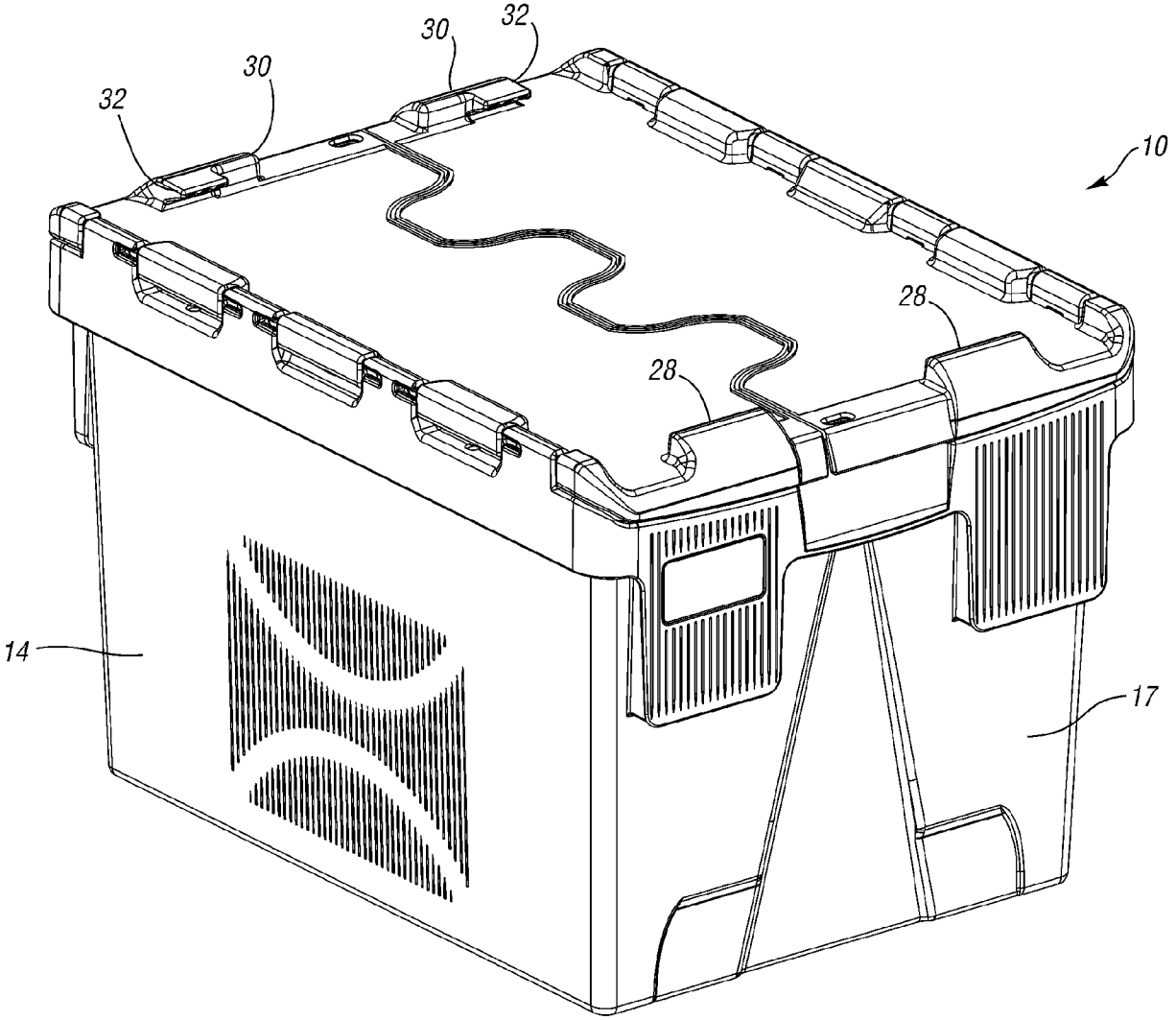
FIG. 2 is a rear perspective view of the example storage container.

A storage container 10 according to a first embodiment of the present invention is illustrated in FIGS. 1-19. Referring to FIGS. 1 and 2, the storage container 10 includes a base 12 and a pair of opposed side walls 14 and a pair of opposed end walls 16, 17 extending upwardly from the periphery of the base 12. Lid halves 18, 20 are hingeably connected to upper edges of the side walls 14. A flange or lip 22 protrudes outward from the upper edge of the side walls 14 and includes a plurality of hinge receivers 24 formed therein. The hinge receivers 24 each hingeably retain a hinge member 26 formed integrally with one of the lid halves 18, 20.

Each of the lid halves 18, 20 further includes stops 28, 30 projecting upwardly from opposite edges above the end walls 16, 17. The stops 30 above end wall 16 also include lateral projections 32 extending from the stops 30. The end wall 16 includes a pair of recesses 44 adjacent the base 12. The recesses 44 are aligned with the lateral projections 32 on the stops 30, such that lateral projections 32 on a subjacent like container 10 would be received within the recesses 44 to increase the stability of a stack of containers 10. The lid halves 18, 20 include lock apertures 34 inward of the stops 28, 30. The inner edge of each lid half 18, 20 includes a plurality of interlocking upper leaves 40.

Figure 3:
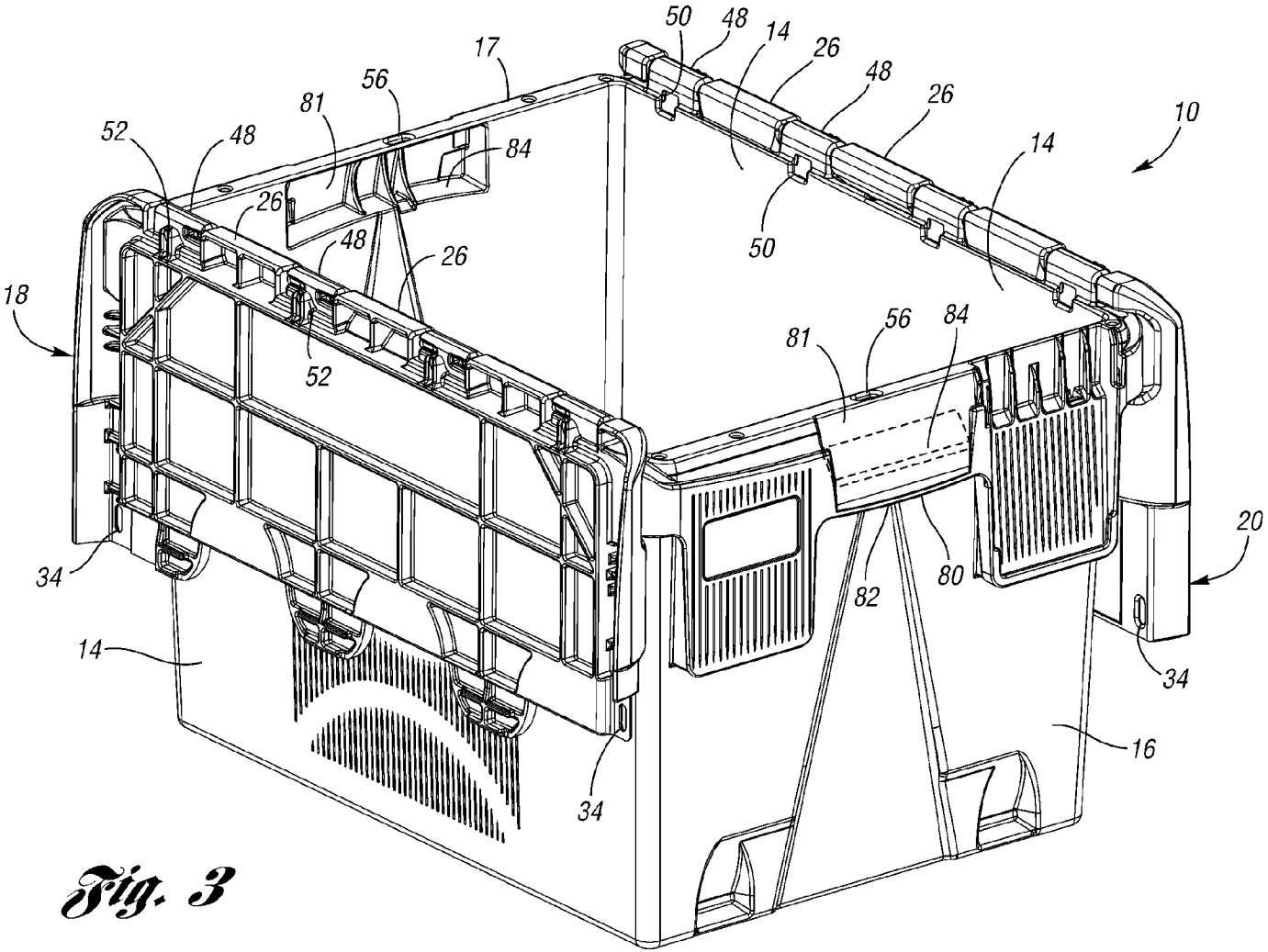
FIG. 3 is a front perspective view of the example storage container with the lid halves open.

As shown in FIG. 3, the lid halves 18, 20 can be pivoted away from one another to provide access to the storage container 10. Each end wall 16, 17 includes a handle 80. The handle 80 has a generally vertical (angled inward slightly) outer wall 81 having a lower edge 82 that curves downward, such that the middle of the lower edge 82 of the outer wall 81 is its lowest point. The handle 80 further includes a generally horizontal inner wall 84 spaced upward from the lower edge 82 behind the outer wall 81. The inner wall 84 is also curved downward, such that the middle of the inner wall 84 is its lowest point. This provides a more comfortable handle 80 that fits that natural curve of the user's hand, since the middle fingers are longer than the others.

Figure 4:
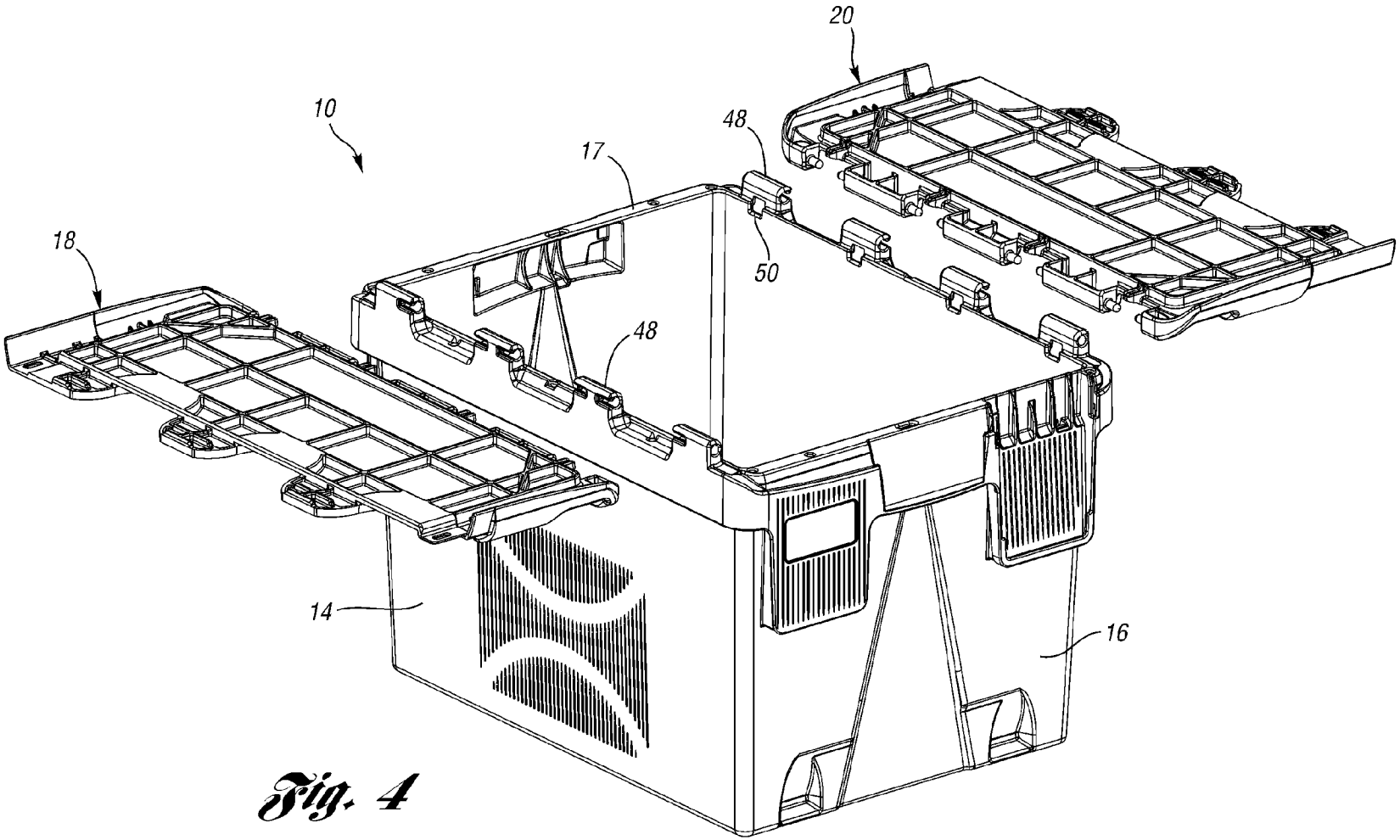
FIG. 4 is an exploded view of the example storage container of the present invention.

As shown in FIGS. 3 and 4, a plurality of hinge retainers 48 protrude upwardly from the upper edges of the side walls 14. A security recess 50 is formed on an inner surface of each hinge retainer 48. Each security recess 50 is aligned with a corresponding security tab 52 projecting laterally from the outer edge of one of the lid halves 18, 20, such that the security tab 52 is interlocked in the security recess 50 when the lid halves 18, 20 are pivoted to the closed position. The upper edges of the end walls 16, 17 each include an aperture for alignment with the lock apertures 34 on the lid halves 18, 20.

Figure 5:
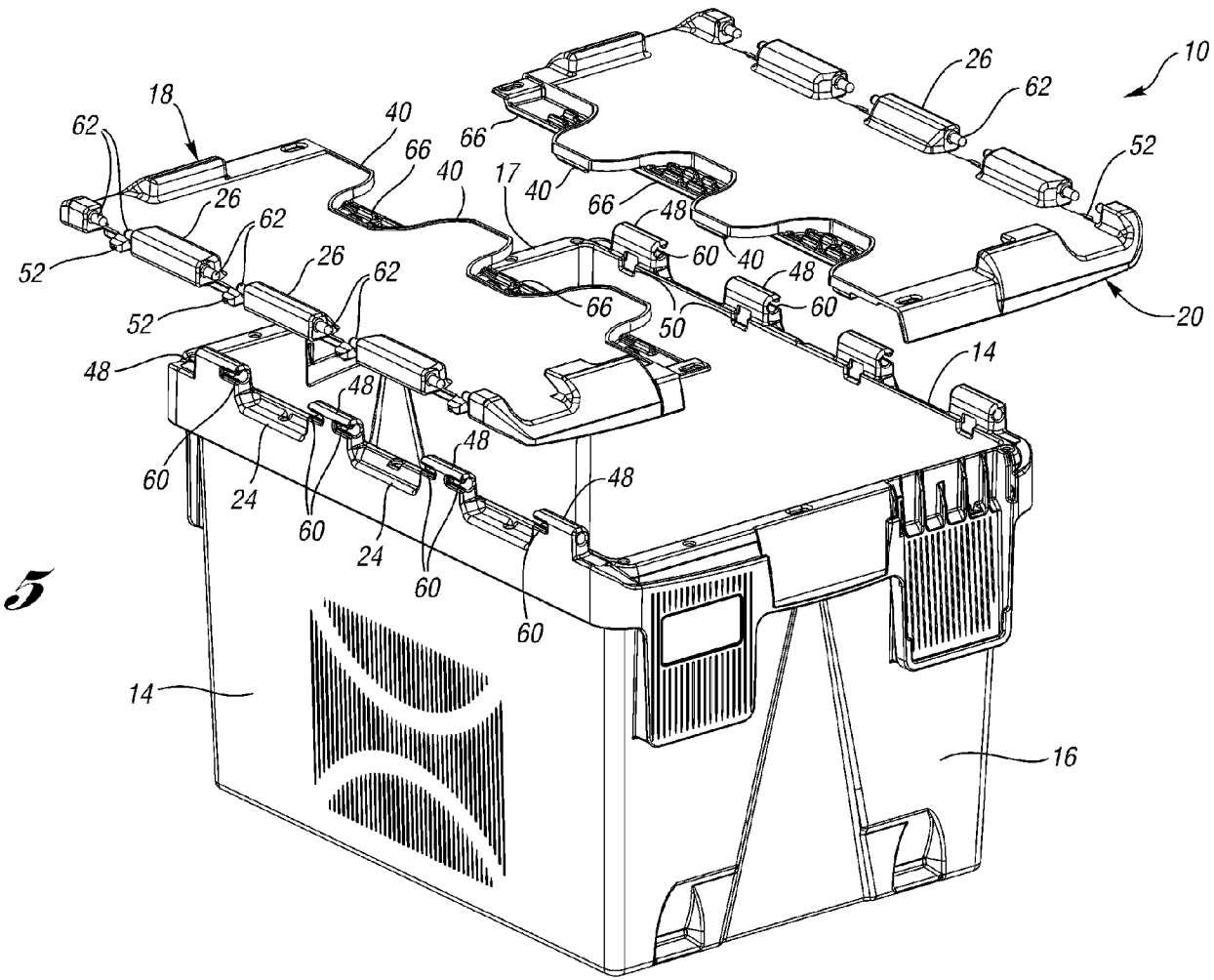
FIG. 5 illustrates the lid halves disassembled from the rest of the storage container.

FIG. 5 illustrates the lid halves 18, 20 disassembled from the rest of the container 10. The hinge receivers 24 each include one or two hinge pin sockets 60 formed in the hinge retainers 48 for pivotably receiving hinge pins 62 that project laterally from the hinge members 26 on the lid halves 18, 20. The hinge pins 62 may snap-fit into the hinge pin sockets 60. The security tabs 52 project outwardly from the lid halves 18, 20 between the hinge pins 62.

The inner edge of each lid half 18, 20 includes the upper leaves 40 alternating with lower leaves 66, such that the upper leaves 40 of one lid half 18, 20 overlap onto the lower leaves 66 of the other lid half 18, 20.

Figure 6:
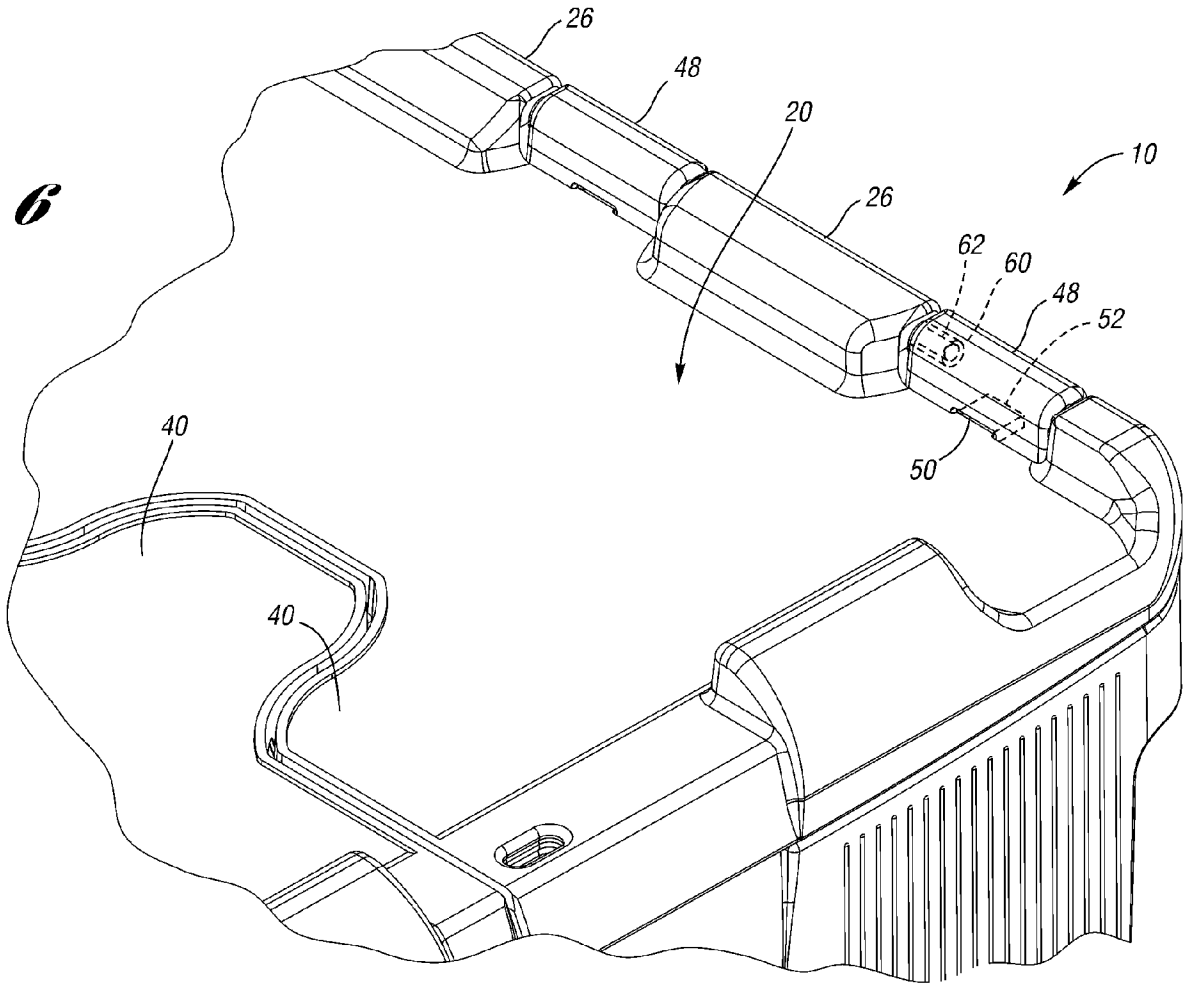
FIG. 6 is an enlarged inner perspective view of one upper corner of the example storage container.
Figure 7:
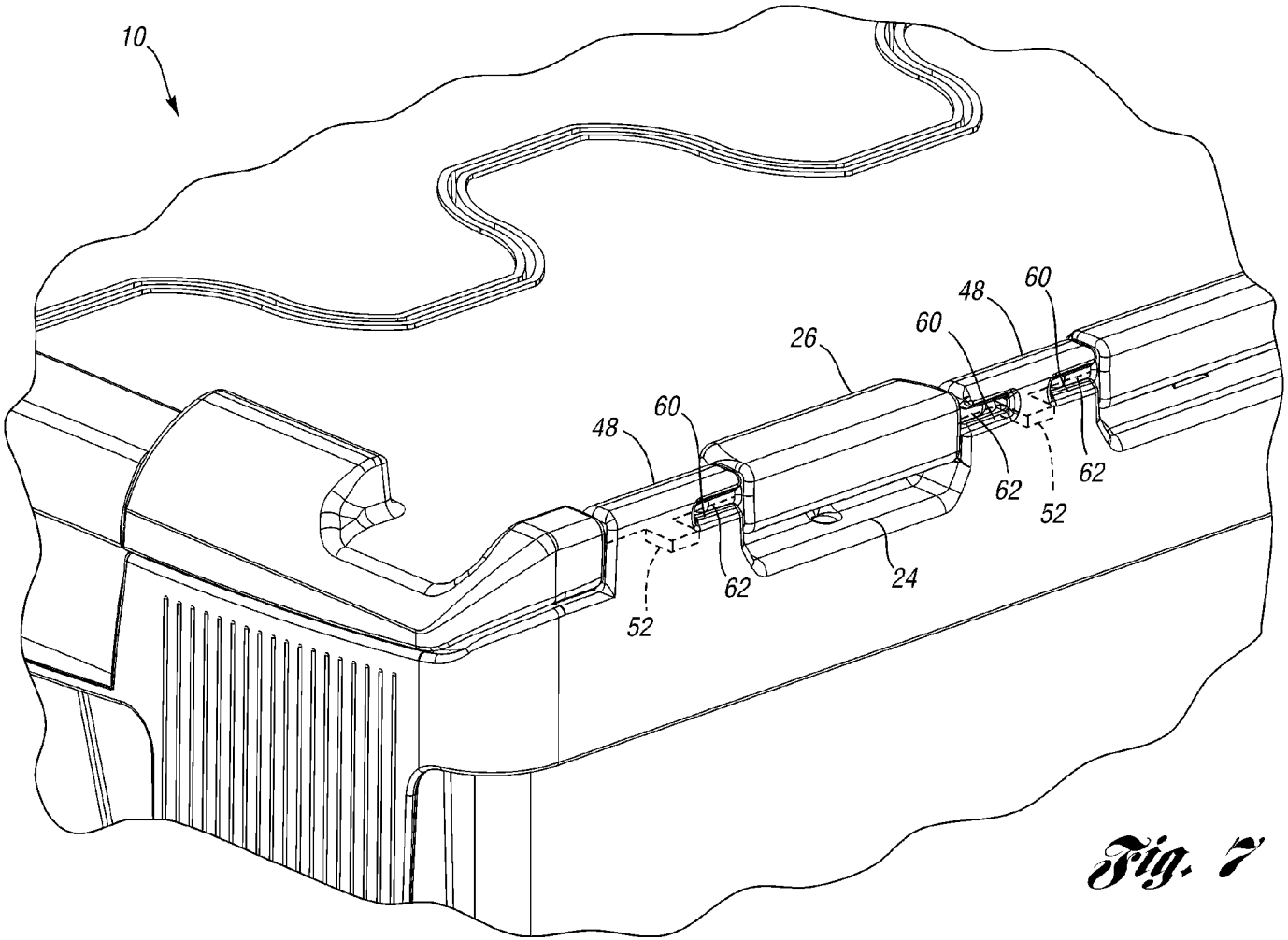
FIG. 7 is an enlarged outer perspective view of the upper corners of FIG. 6.

FIGS. 6 and 7 are enlarged inner and outer perspective views, respectively, of one upper corner of the storage container 10. With the lid 20 in the closed position, each security tab 52 is received in a security recess 50 of a hinge retainer 48, thus preventing vertical movement of the outer edge of the lid half 20. Each hinge pin 62 extending from a hinge member 26 is received in a hinge pin socket 60 in a hinge retainer 48.

Figure 8:
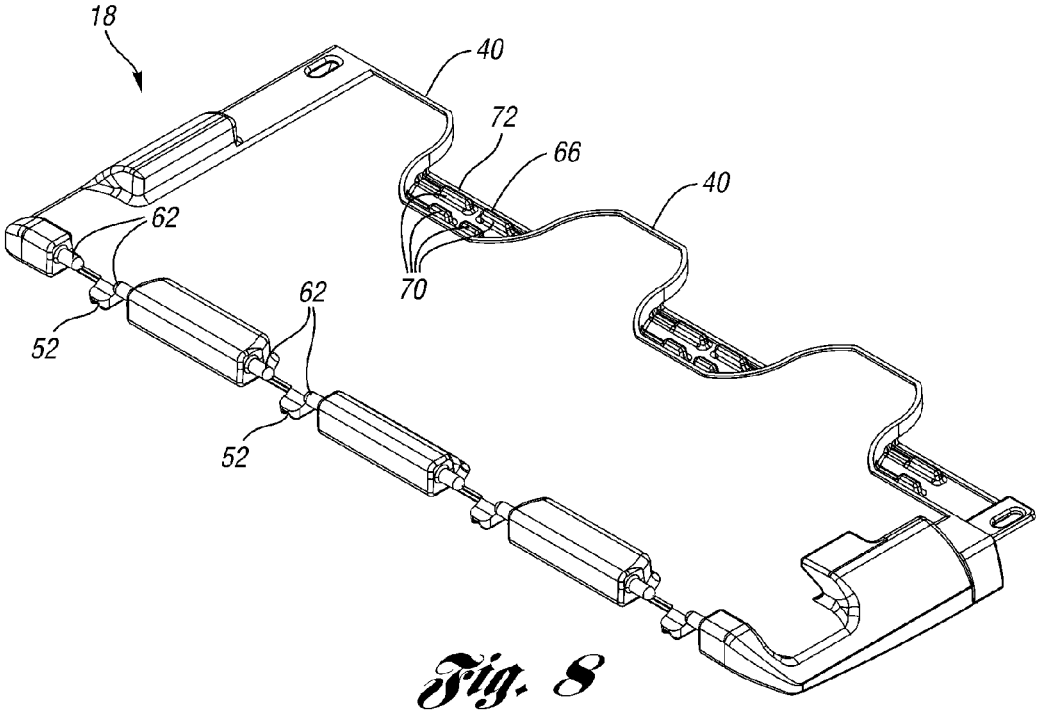
FIG. 8 illustrate the first lid half of the storage container of FIG. 1.
Figure 9:
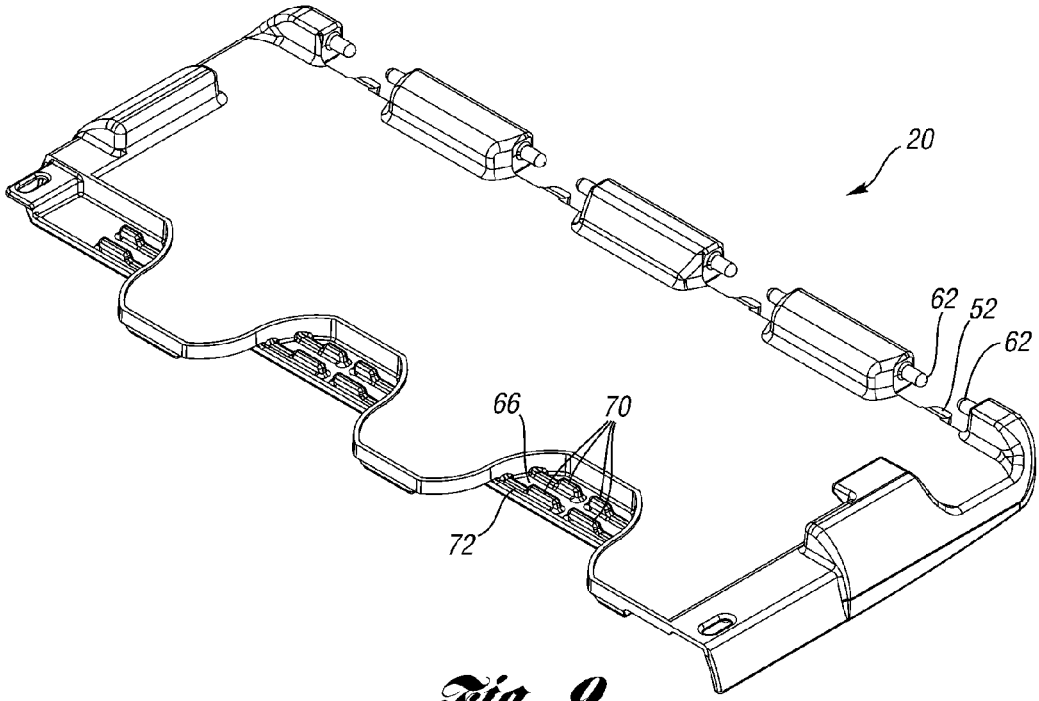
FIG. 9 illustrate an example second lid half of the storage container of the present invention.
Figure 10:
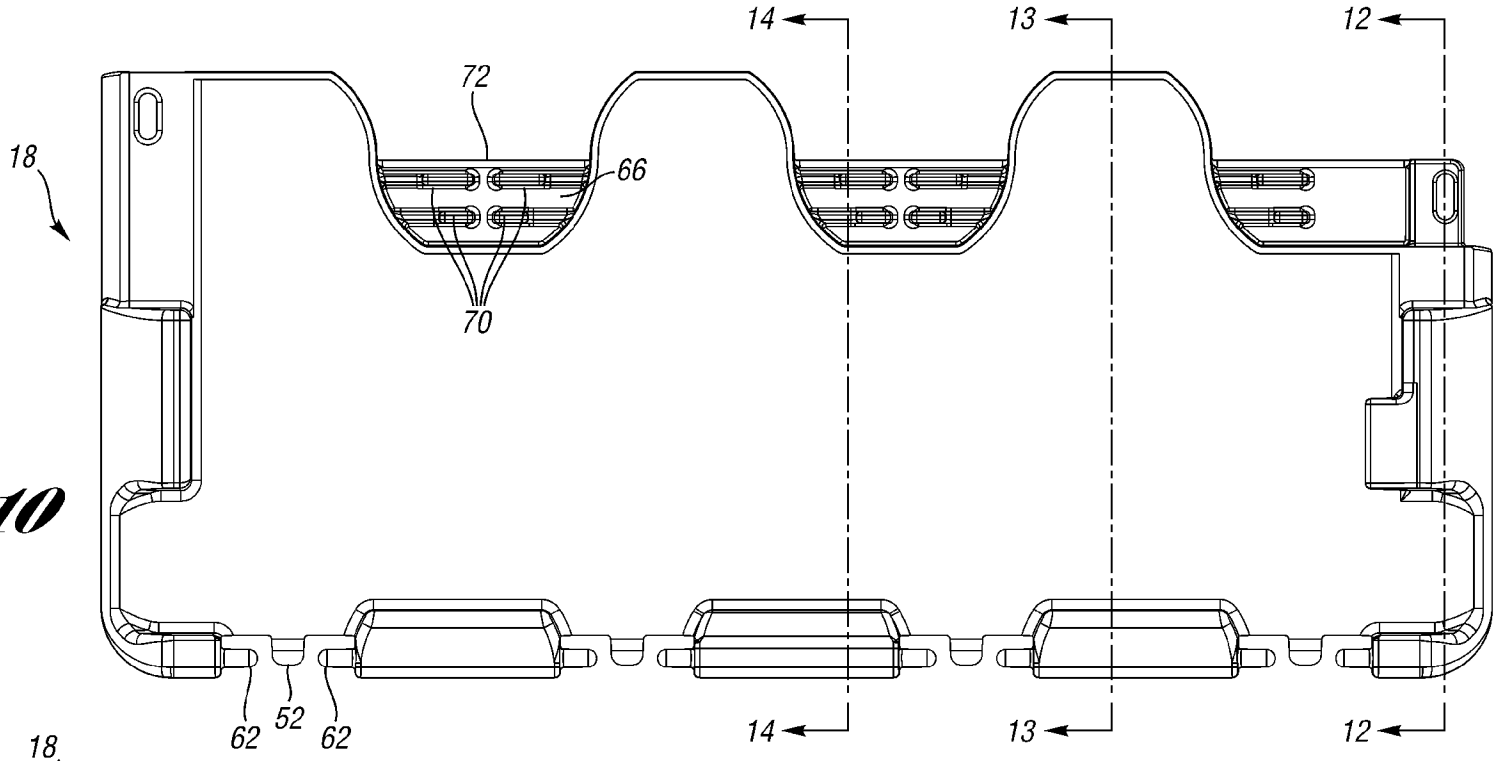
FIG. 10 is a top view of an example lid half of the storage container of the present invention.
Figure 11:
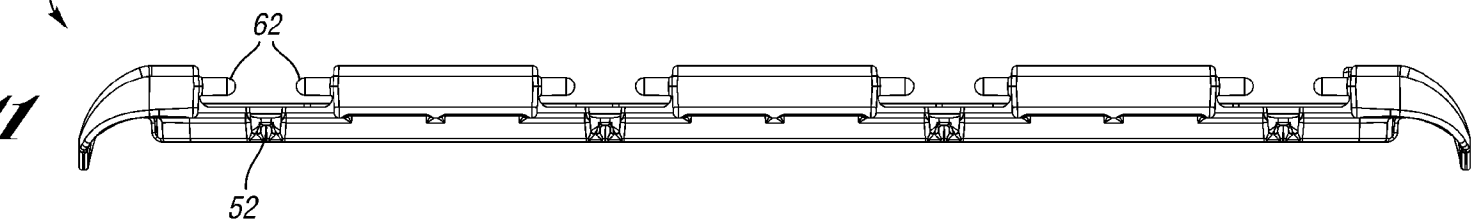
FIG. 11 is an end view of the example lid half of the storage container of the present invention.

FIGS. 8 and 9 illustrate the two lid halves 18, 20. The lower leaves 66 each include a plurality of protrusions 70 behind a lip 72 extending upwardly from the lower flange 66. The lip 72 helps prevent any moisture that seeps between the lid halves 18, 20 from entering the container 10. FIGS. 10 and 11 are top and side views of the lid half 18, respectively.

Figure 12:
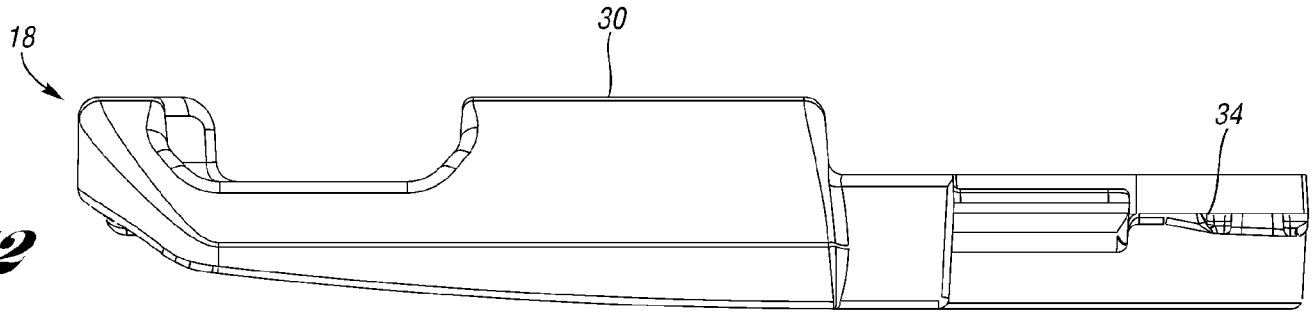
FIG. 12 is a sectional view taken along lines 12-12 of FIG. 10.
Figure 13:
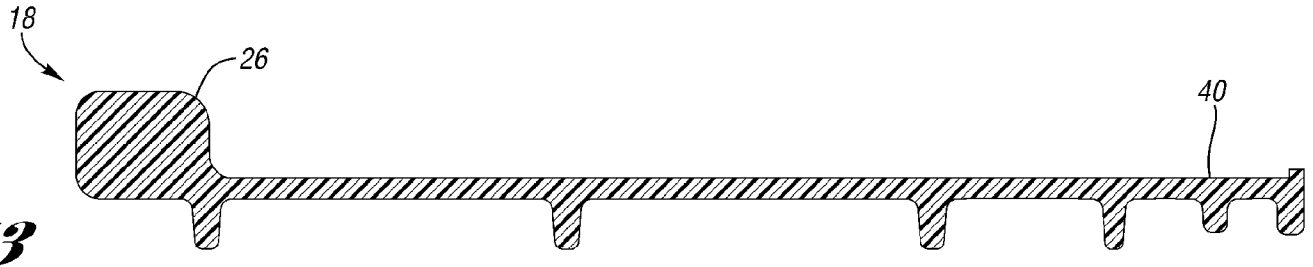
FIG. 13 is a sectional view taken along lines 13-13 of FIG. 10.

FIG. 12 is a sectional view taken along lines 12-12 of FIG. 10. FIG. 13 is a sectional view taken along lines 13-13 of FIG. 10.

Figure 14:
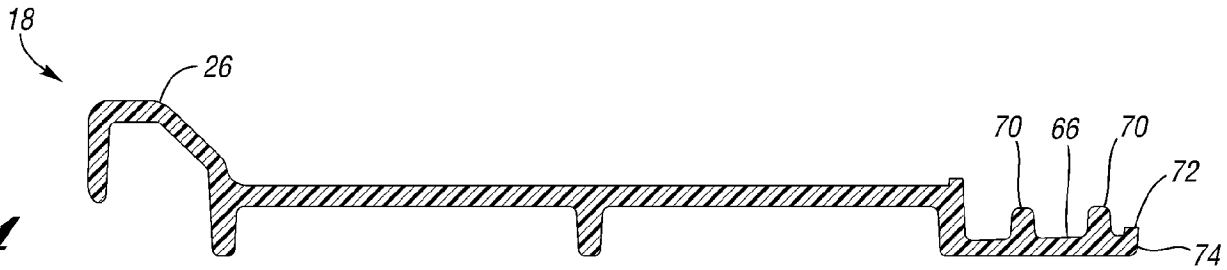
FIG. 14 is a sectional view taken along lines 14-14 of FIG. 10.

FIG. 14 is a sectional view taken along lines 14-14 of FIG. 10. Referring to FIG. 14, the lip 72 assists in preventing moisture from seeping between overlapping upper leaves 40 (FIG. 13) and lower leaves 66 (FIG. 14). The base 74 of the lower leaf 66 is thicker near the lip 72, such that an upper surface of the base 74 is sloped away from the lip 72. The lip 72 and the protrusions 70 extend upward from the base 74. Alternatively, the lip 72 could be partially or completely defined adjacent a recess (not shown) in the base 74 of the lower leaf 66. The slope could be in a direction perpendicularly away from the lip 72 or could direct water along the lip 72 or away from the lip 72 at an acute angle.

Figure 15:
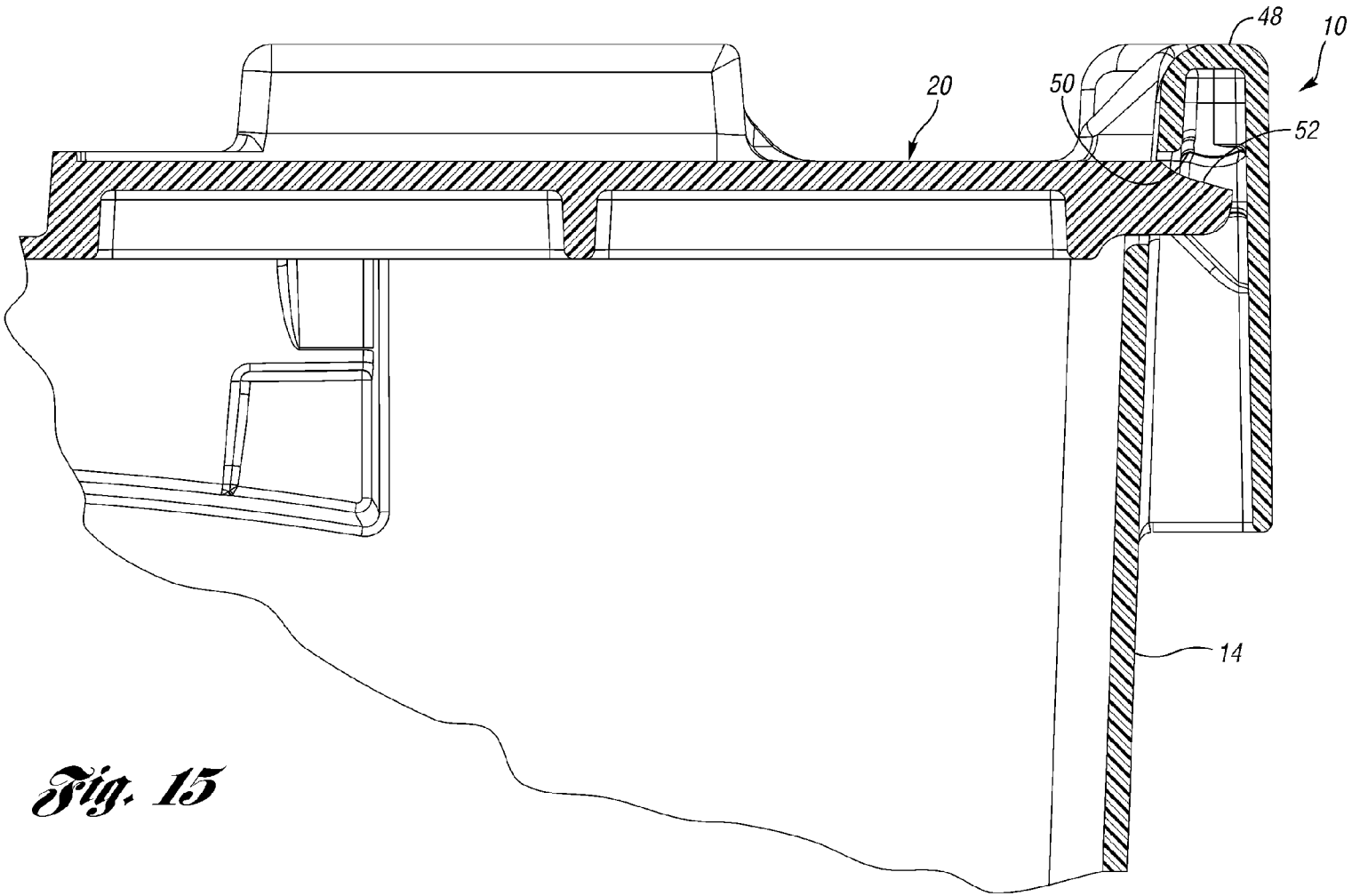
FIG. 15 is a sectional view of the storage container with the lid half in the closed position.

FIG. 15 is a sectional view of the storage container 10 with the lid half 20 in the closed position. In the closed position, the security tab 52 is received within the security recess 50 in the hinge retainer 48. Thus, when the inner edges of the lid halves 18, 20 are locked through apertures 34 and 56 (FIG. 3), the security tabs 52 would prevent the outer edges of the lid halves 18, 20 from being lifted vertically, even if the hinges are defeated. At the least, if the outer edge of the lid halves 18, 20 were pried away from the side wall 14, the security tabs 52 would break, giving a visual indication that the storage container 10 has been opened without authorization.

Figure 16:
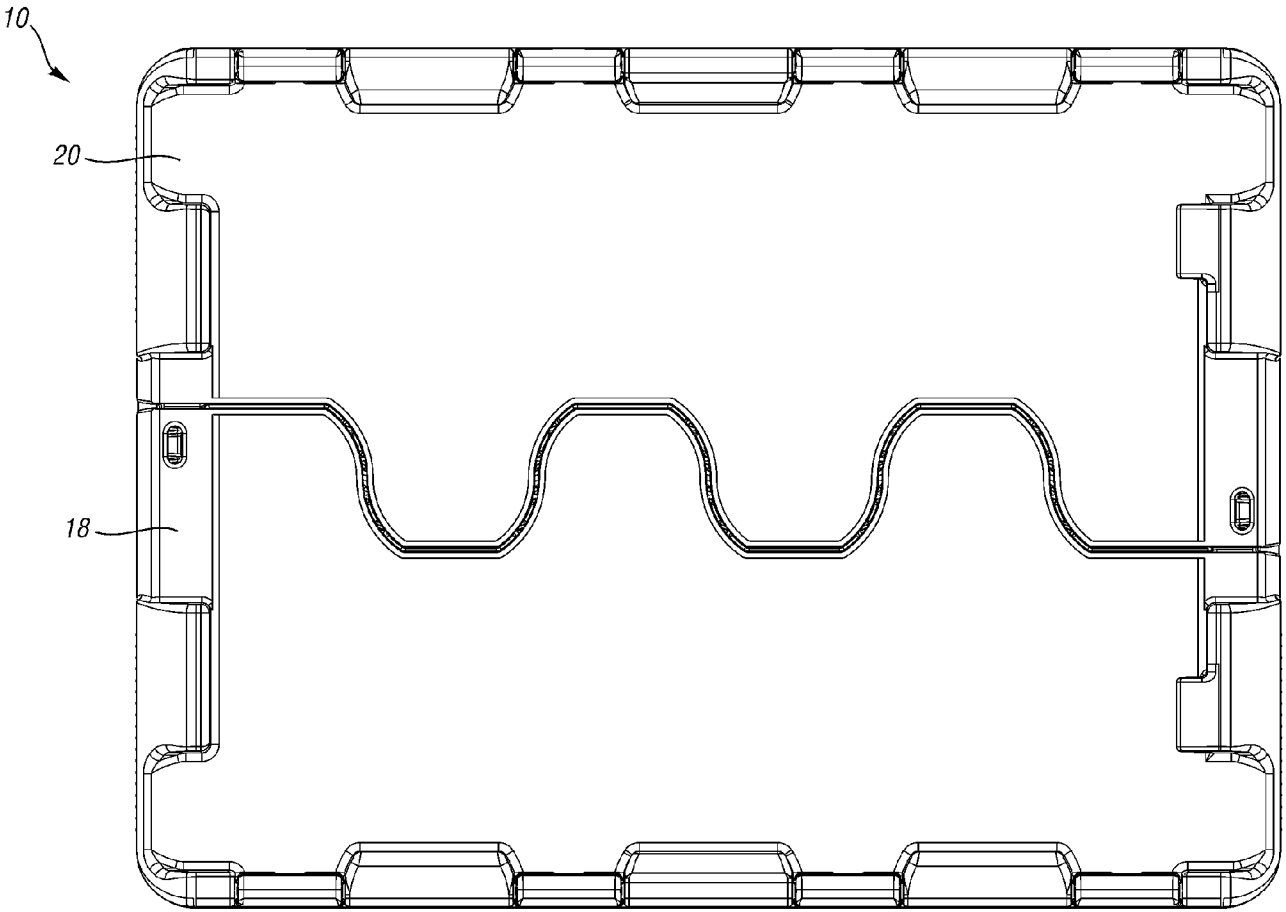
FIG. 16 is a top view of the storage container of the present invention with when the lid halves are closed.
Figure 17:
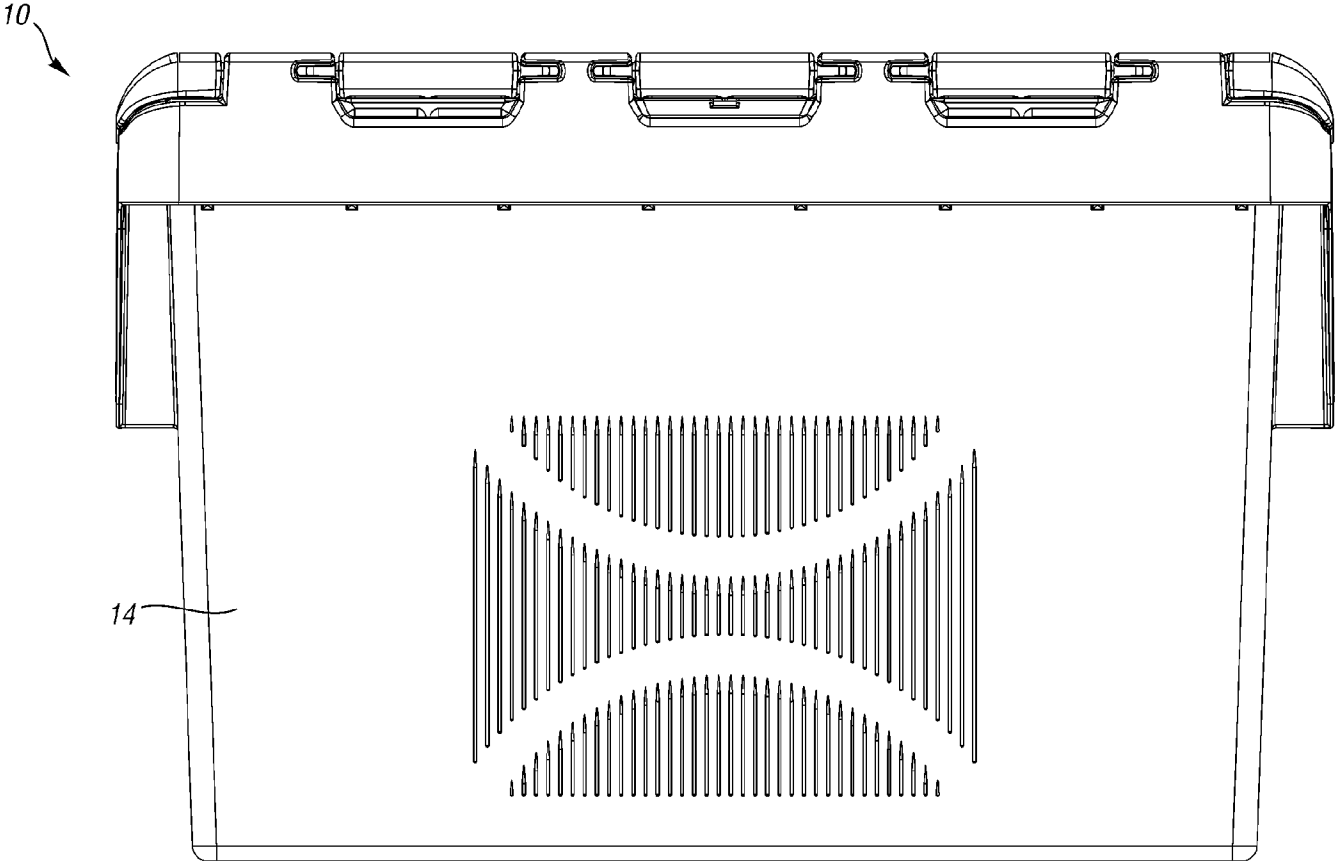
FIG. 17 is a side view of the example storage container of the present invention.
Figure 18:
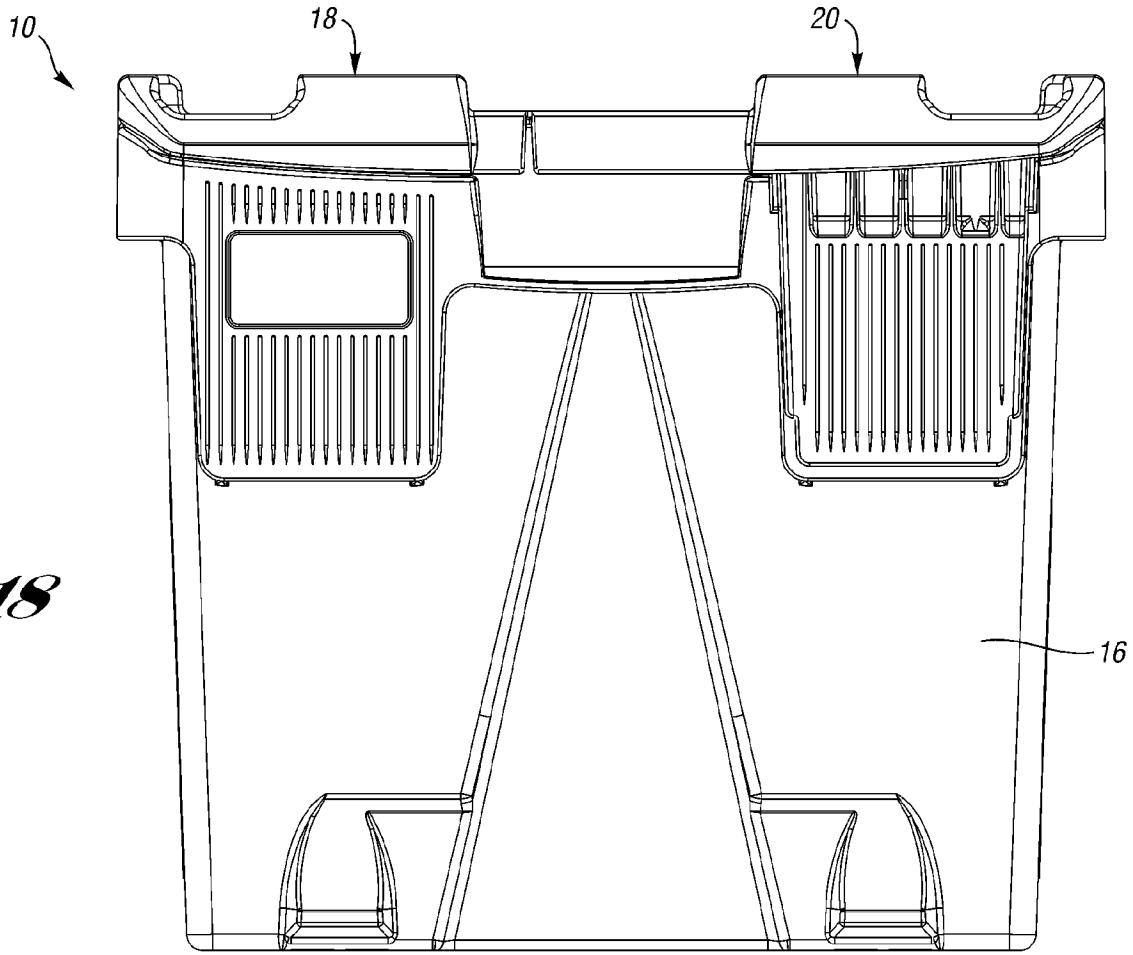
FIG. 18 an end view of the example storage container of the present invention.
Figure 19:
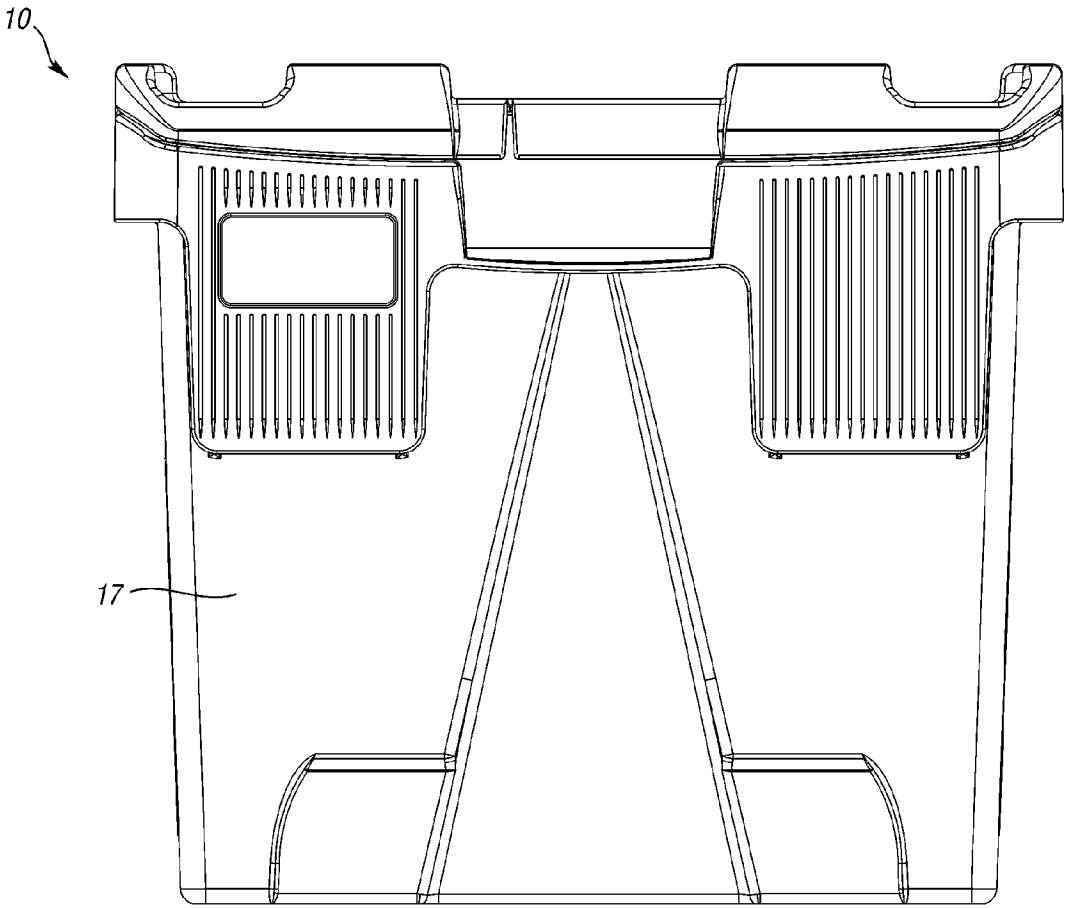
FIG. 19 is another end view of the example storage container of the present invention.

FIG. 16 is a top view of the storage container 10 when closed. FIG. 17 is a side view of the storage container 10. FIGS. 18 and 19 are end views of the storage container 10.

FIGS. 20-27 illustrate a storage container 110 according to a second embodiment of the present invention. To the extent not stated or illustrated otherwise, the storage container 110 is similar to the container 10 of FIGS. 1-19, the description of which is hereby incorporated by reference. Components corresponding to those of FIGS. 1-19 are indicated with the same reference numerals prefixed with a "1." The description of the storage container 110 will therefore focus on three additional features, which could also be incorporated into the storage container 10 of FIGS. 1-19.

Figure 20:
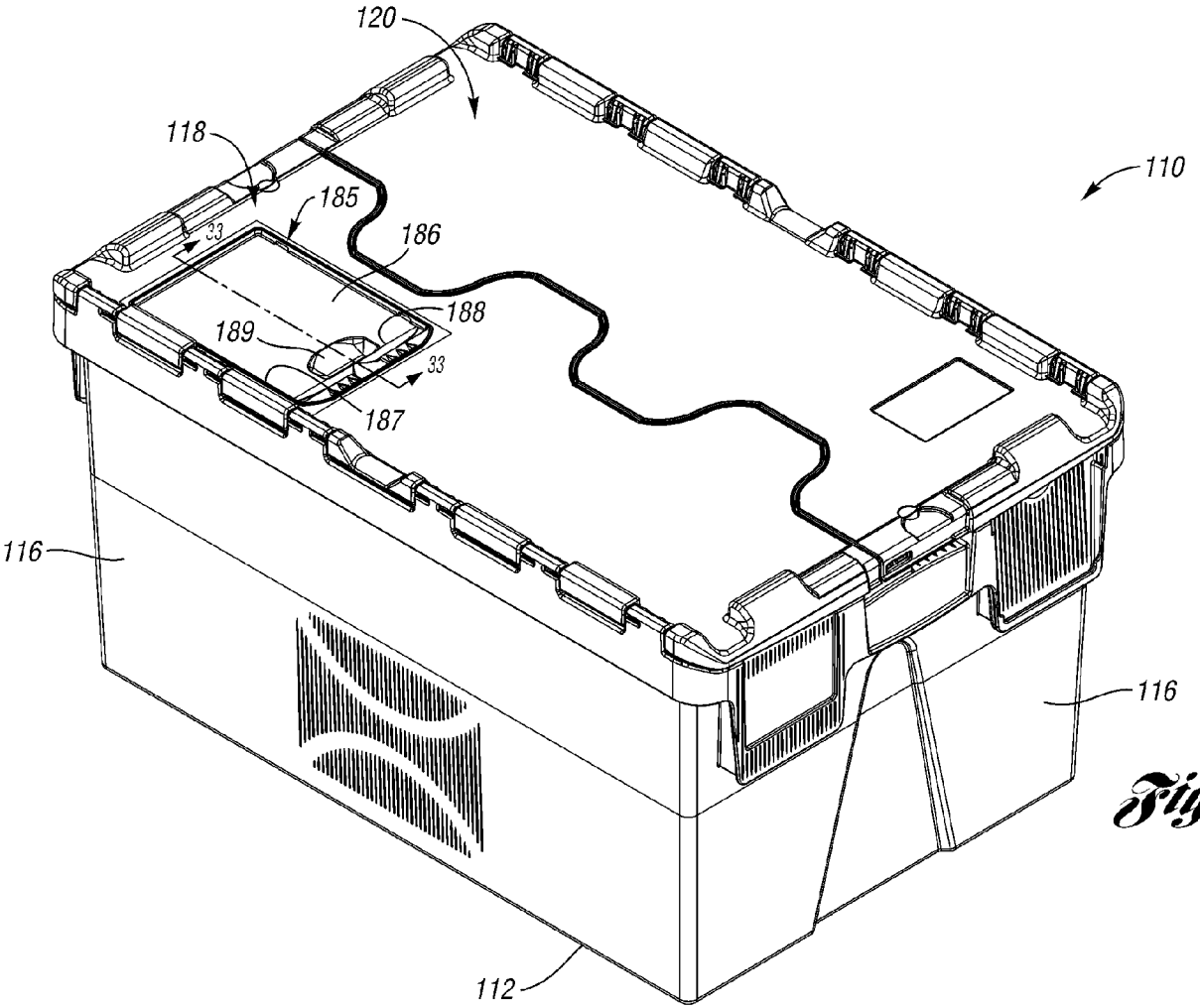
FIG. 20 is a perspective view of an example storage container according to a second embodiment of the present invention.
Figure 21:
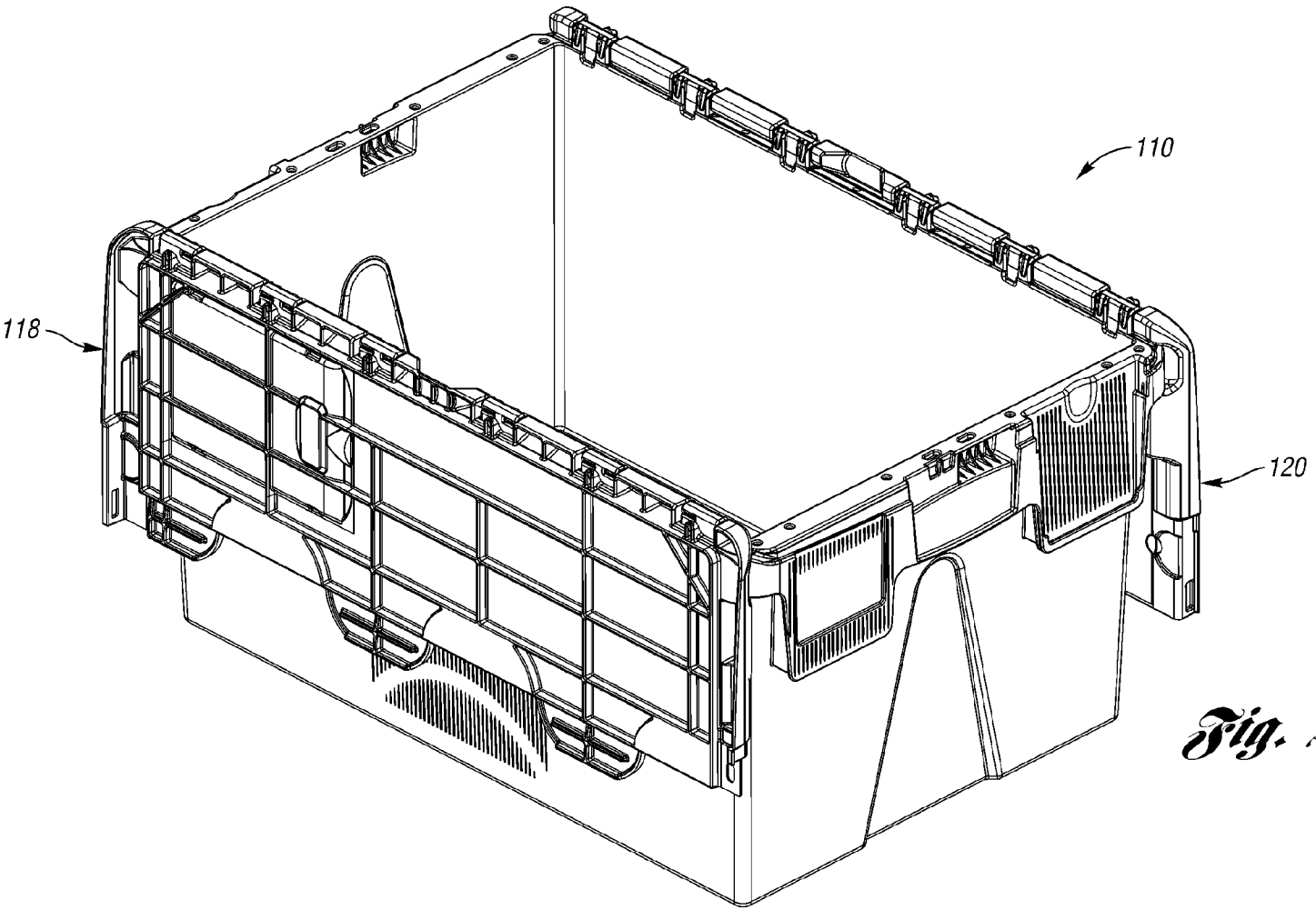
FIG. 21 is a perspective view of the example storage container according to the second embodiment with the lid halves open.
Figure 22:
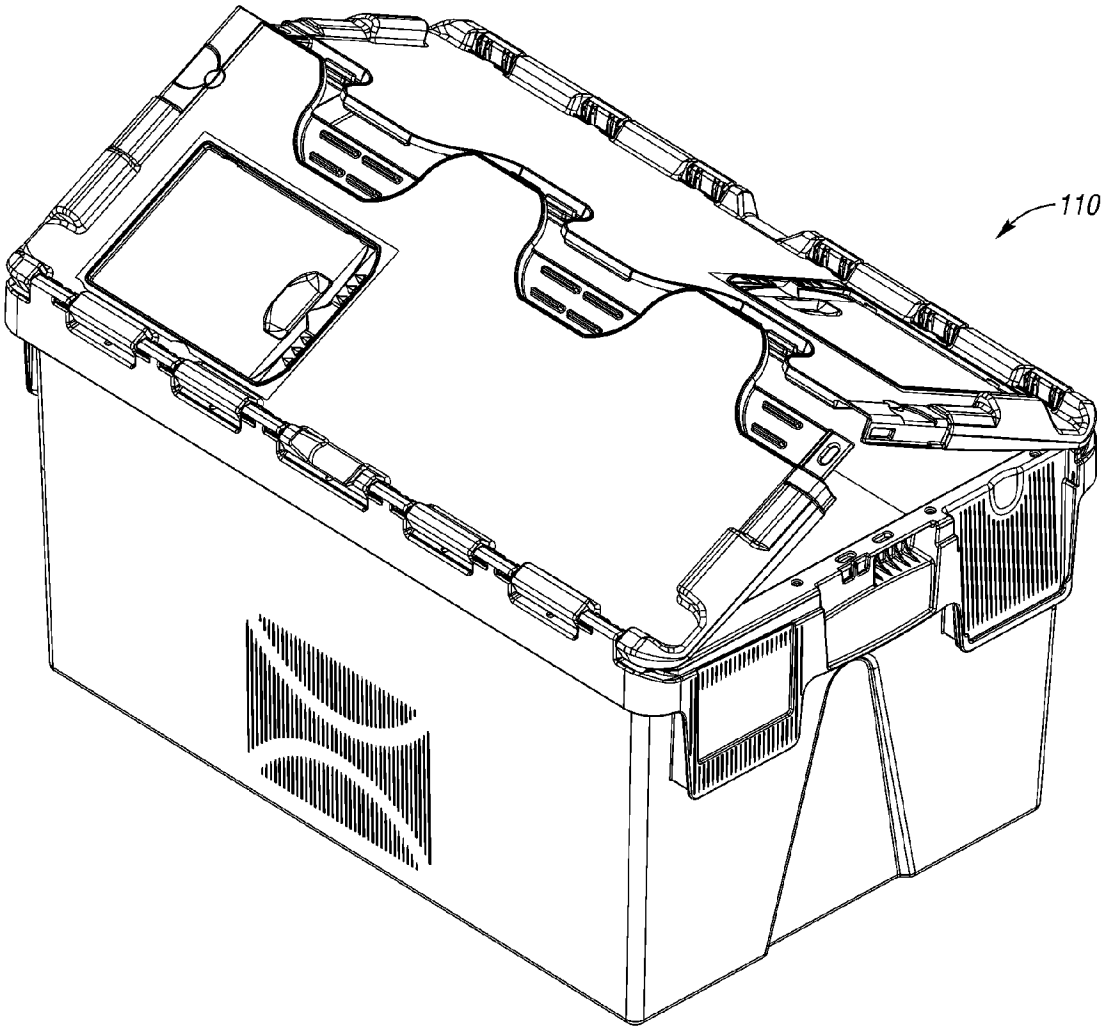
FIG. 22 is a perspective view of the example storage container according to the second embodiment with the lid halves partially open.
Figure 27:
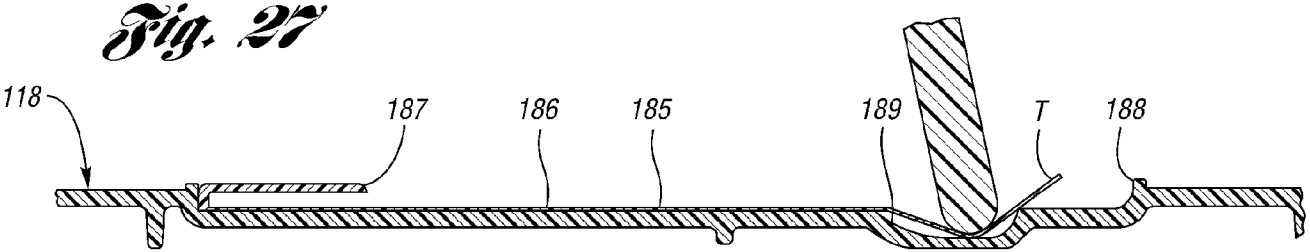
FIG. 27, is a cross-sectional view through the pocket on one lid half of the example second embodiment of the storage container.

First, referring to FIGS. 20 and 27, the lid half 118 includes a pocket 185 for holding an identification ticket T (ticket T is shown only in FIG. 27) for shipping the storage container 110. The pocket 185 includes a lower surface 186 and a peripheral tab 187 spaced away from the lower surface. The peripheral tab 187 retains the ticket in the pocket 185 and extends about most of the periphery of the pocket 185 except for an opening 188. The pocket 185 further includes a recess 189 adjacent the opening 188. As shown in FIG. 27, when the ticket T is pressed at the location of the recess 189, the end of the ticket T lifts up, enabling it to be grasped more easily.

Figure 23:
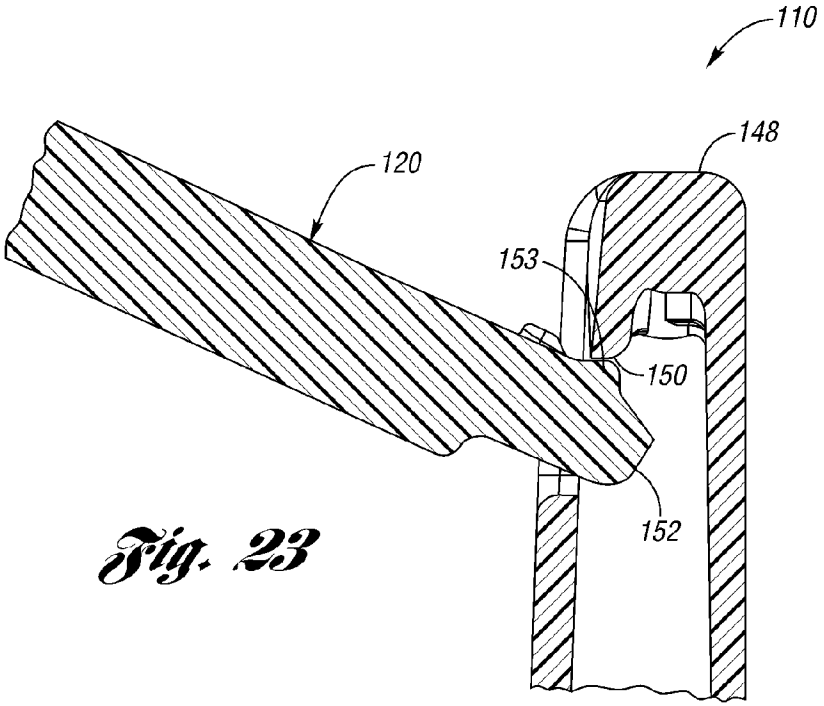
FIG. 23 is a sectional view of one of the lid halves through the security tab and through the corresponding hinge retainer.
Figure 24:
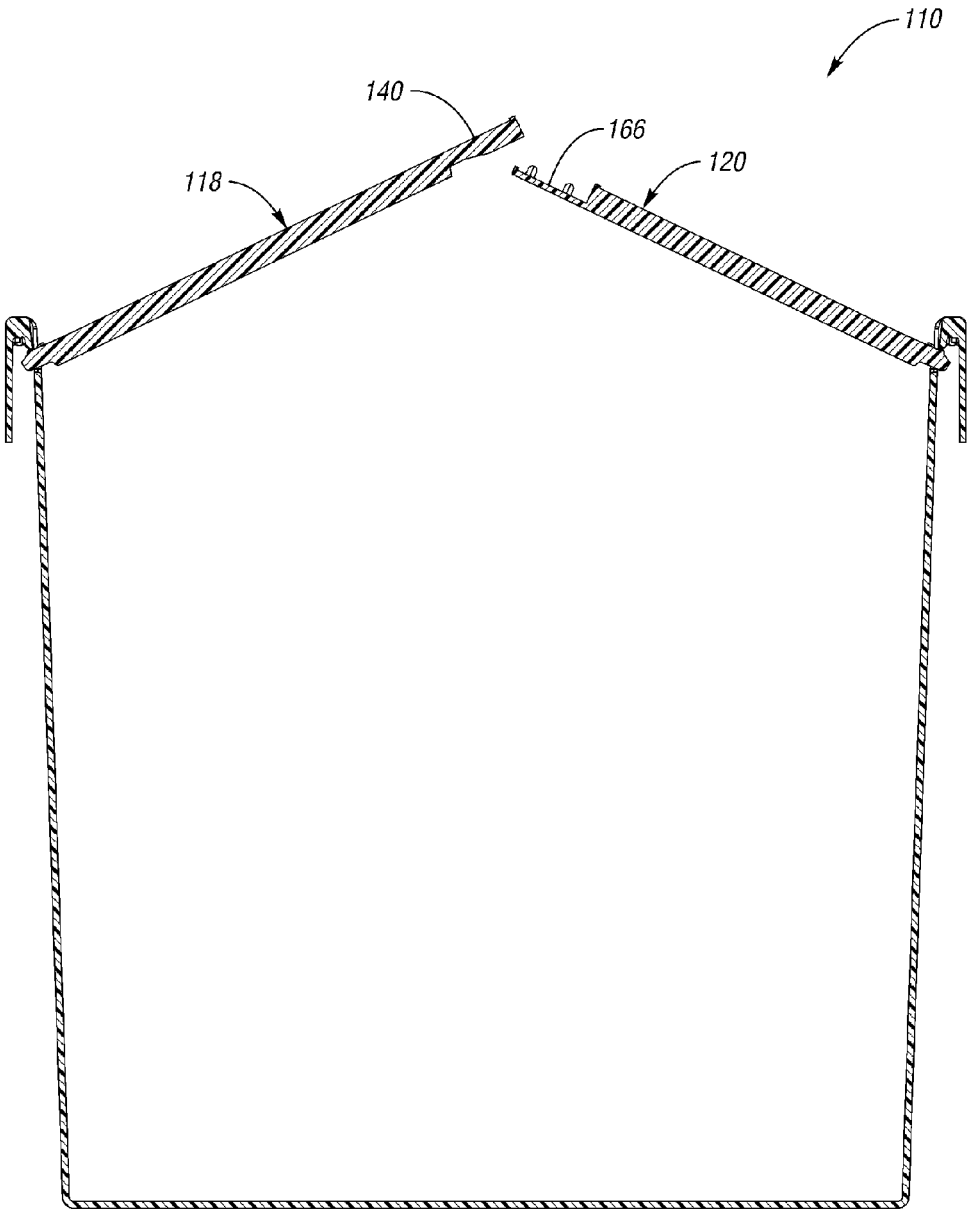
FIG. 24 is a cross-sectional view of an example storage container according to the second embodiment with the lid halves partially open.
Figure 25:
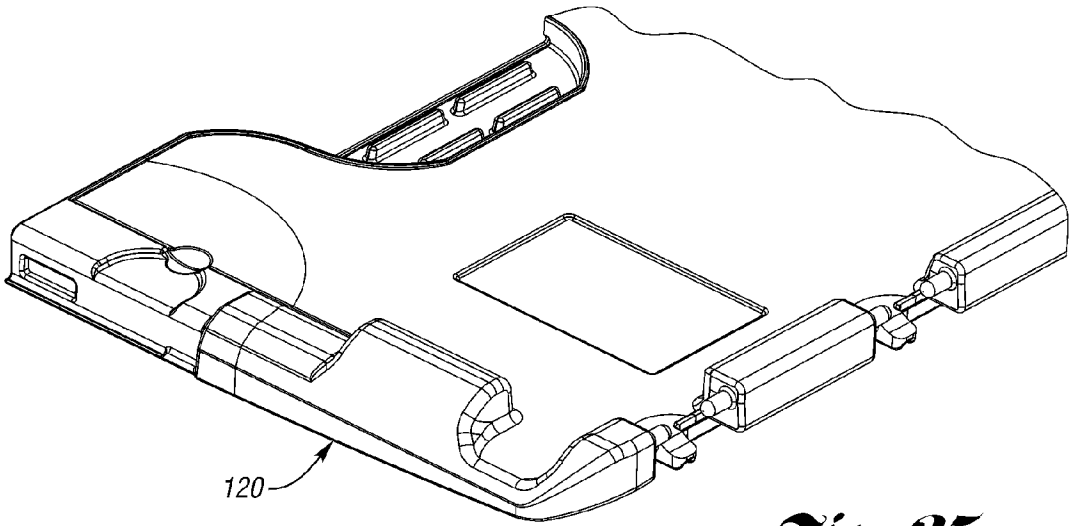
FIG. 25 is an enlarged outer perspective view of one lid half corner of the example second embodiment of the storage container.

The second additional feature of the second embodiment is shown most clearly in FIGS. 23 and 24. FIG. 23 is a sectional view through one of the lid halves 120 through the security tab 152 and through the corresponding hinge retainer 148. Referring to FIG. 23, each security tab 152 includes an upward projection 153 for contacting the hinge retainer 148 adjacent the security recess 150 while the lid half 120 is being closed. The projection 153 provides sufficient interference to keep the lid half 120 open to the angle shown under its own weight, but can easily be overcome by pressing down on the lid half 120, at which time the security tab 152 is received in the security recess 150 in the manner described above. The other lid half 118 has similar security tabs 152. With this feature, the lid halves 118, 120 can be left momentarily in the position shown in FIG. 24, while the user ensures that the upper leaves 140 and lower leaves 166 are properly overlapped in the required alternating manner. The lid halves 118, 120 can then both be pressed down simultaneously into a fully closed position. In particular, this facilitates operation of the storage container 110 with one hand.

Figure 26:
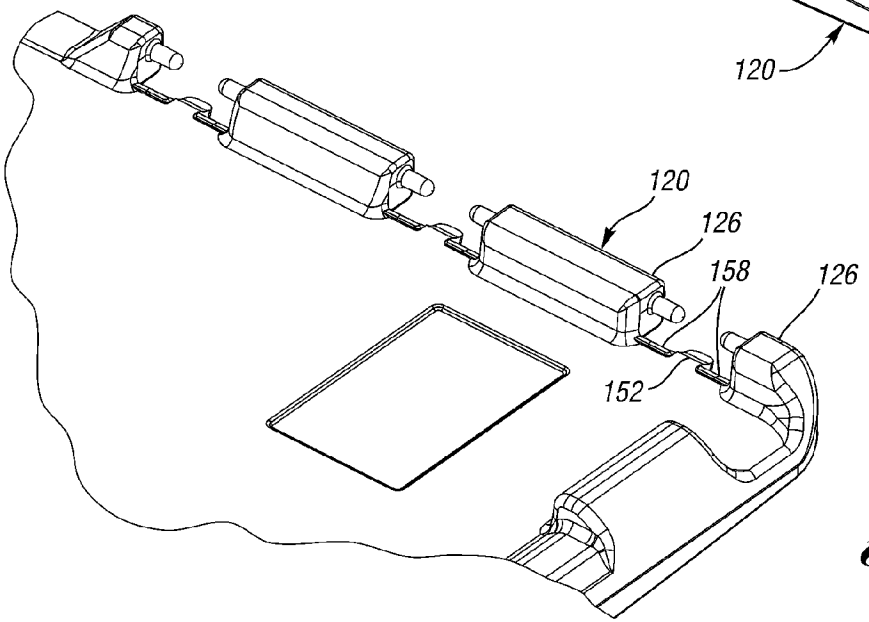
FIG. 26 is an enlarged inner perspective view of one lid half corner of the example second embodiment of the storage container.

The third additional feature of the second embodiment can be seen most clearly in FIG. 26. The upper surface of the lid half 120 includes a lip 158 along the outer edge of the lid half 120 between the hinge member 126 and the security tabs 152 (lid half 118 includes a similar lip 158). This prevents moisture from seeping into the storage container 110 between the lid halves 118, 120 and the hinge retainers 148. The lip 158 could alternatively be defined as an area adjacent a recess formed in the upper surface of the lid half 120, such that the recess could carry moisture away from the outer edge of the lid half 120.

The storage containers 10, 110, including lid halves 18, 20, 118, 120, are preferably injection molded from a plastic material, such as high density polyethylene (HDPE), but other materials and processes could also be used. As indicated above, one or more features from either embodiment can be incorporated into the other embodiment.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A storage container comprising:

a base;

a wall extending upwardly from the base, the wall including an integrally molded first hinge member including one of a hinge pin and a hinge pin socket, and the wall includes a first interlocking feature; and a lid having an integrally molded second hinge member hingeably connected to the integrally molded first hinge member, and the integrally molded second hinge member includes the other of the hinge pin and the hinge pin socket, the lid including a second interlocking feature, the first interlocking feature interlocking with the second interlocking feature to secure the lid to the wall, and the hinge pin is pivotably received in the hinge pin socket, wherein the lid and the hinge members prevent access to the first interlocking feature and the second interlocking feature when the lid is in a closed position relative to the wall.

2. The storage container of claim 1, wherein the first interlocking feature and the second interlocking feature prevent an end of the lid hingeably connected to the wall from moving upwardly from the wall when the lid is in the closed position.

3. The storage container of claim 1, wherein the first interlocking feature and the second interlocking feature interlock on an axis perpendicular to an axis of a hinge defined by the integrally molded first hinge member and the integrally molded second hinge member.

4. The storage container of claim 1, wherein the first interlocking feature is a slot within the wall, the second interlocking feature is a tab protruding from the lid and wherein the tab interlocks with the slot.

5. A storage container comprising:

a base;

a wall extending upwardly from the base, the wall including an integrally molded first hinge member including one of a hinge pin and a hinge pin socket, and the wall includes a first interlocking feature; and a lid having an integrally molded second hinge member hingeably connected to the integrally molded first hinge member, and the integrally molded second hinge member includes the other of the hinge pin and the hinge pin socket, the lid including a second interlocking feature, the first interlocking feature interlocking with the second interlocking feature to secure the lid to the wall, and the hinge pin is pivotably received in the hinge pin socket, wherein the first interlocking feature is located on an interior side of a hinge retainer formed in the wall.

6. The storage container of claim 1, wherein a hinge connects the lid to the wall, the hinge including a lip protruding upwardly to prevent water intrusion through the hinge.

7. The storage container of claim 1, wherein the lid has a stop extending upwardly on an opposing end of the lid from the second interlocking feature.

8. The storage container of claim 7, wherein an end wall extends upwardly from an adjacent side of the base, and the end wall has a recess formed on a lower edge and corresponding to a location of the stop.

9. A storage container comprising:

a base;

a first wall extending upwardly from the base;

a first lid; and a first hinge connecting the first lid to the first wall, wherein the first lid includes a first upper leaf, a second upper leaf and a lower leaf formed on an end opposing the first hinge and a lip protruding upwardly from the lower leaf when the first lid is in a closed position and extending continuously from the first upper leaf to the second upper leaf to prevent water intrusion past the first lid, wherein the lower leaf includes a plurality of protrusions extending upwardly, and the lip has a first height and the plurality of protrusions have a second height, and the second height is greater than the first height.

10. The storage container of claim 9, wherein a second wall extends upwardly from the base on an opposing side from the first wall, a second hinge connects a second lid to the second wall, and the second lid includes a first lower leaf, a second lower leaf and an upper leaf formed on an end opposing the second hinge and a lip protruding upwardly from the first lower leaf and the second lower leaf to prevent water intrusion past the second lid.

11. The storage container of claim 10, wherein the first upper leaf of the first lid overlaps the first lower leaf of the second lid, the upper leaf of the second lid overlaps the lower leaf of the first lid, and the second upper leaf of the first lid overlaps the second lower leaf of the second lid when the lids are in the closed position relative to the first wall and the second wall.

12. A storage container comprising:

a base;

a wall extending upwardly from the base, the wall including at least one first hinge member; and a lid having a plurality of second hinge members protruding upwardly therefrom, the at least one first hinge member connected to the plurality of second hinge members to pivotably connect the lid to the wall, the lid including a lip protruding upwardly from the lid between the plurality of second hinge members to prevent water intrusion through a hinge defined by the at least one hinge member and the plurality of second hinge members.

13. A storage container comprising:

a base;

a wall extending upwardly from the base, the wall including at least one first hinge member; and a lid having a plurality of second hinge members protruding upwardly therefrom, the at least one first hinge member connected to the plurality of second hinge members to pivotably connect the lid to the wall, the lid including a lip protruding upwardly from the lid between the plurality of second hinge members to prevent water intrusion through a hinge defined by the at least one first hinge member and the plurality of second hinge members, wherein the lid includes a pocket secured to an upper side of the lid, and wherein a recess is formed in the pocket adjacent to an opening of the pocket to assist in accessing an interior of the pocket.

14. The storage container of claim 13, wherein a tab surrounds a portion of a periphery of the pocket to retain a document within the pocket.

15. The storage container of claim 13, further including a document in the pocket, wherein an edge of the document within the pocket is raised from a surface of the lid when pressure is applied to the document through the recess in the pocket.

16. The storage container of claim 12, wherein the lid includes a security feature having a first projection extending upwardly from the lid adjacent to the hinge and a second projection extending outwardly from lid, and the first projection is received with a recess in the wall when the lid is in a partially closed position such that interference between the wall and the lid prevents the lid from moving into a closed position.

17. The storage container of claim 16, wherein the second projection is moved from the recess when downward force is applied to the lid.

18. The storage container of claim 16, wherein the second projection is received within the recess when the lid is in a fully closed position.

19. A storage container comprising:

a base;

a plurality of walls extending upwardly from the base;

a first lid and a second lid each hingeably connected to the walls, each of the first lid and the second lid having a plurality of alternatingly overlapping leaves extending toward one another; and a first hinge connecting the first lid to one of the plurality of walls and a second hinge connection the second lid to another of the plurality of walls, wherein at least one of the first hinge and the second hinge includes a security feature to retain at least one of the first lid and the second lid, respectively, in a partially closed position.

20. The storage container of claim 19, wherein the at least one of the first lid and the second lid includes a first projection extending upwardly from the at least one of the first lid and the second lid adjacent to the hinge and a second projection extending outwardly from the at least one of the first lid and the second lid adjacent to the hinge.

21. The storage container of claim 2, wherein the first projection is received with a recess in the wall when the at least one of the first lid and the second lid is in a partially closed position such that interference between the wall and the at least one of the first lid and the second lid prevents the lid from moving into a closed position.

22. The storage container of claim 21, wherein the second projection is moved from the recess when downward force is applied to the at least one of the first lid and the second lid.

23. The storage container of claim 21, wherein the second projection is received within the recess when the at least one of the first lid and the second lid is in a fully closed position.

24. The storage container of claim 19, wherein the at least one of the first hinge and the second hinge includes a lip protruding upwardly to prevent water intrusion through the hinge.

25. The storage container of claim 19, wherein the at least one of the first lid and the second lid includes a first upper leaf and a first lower leaf formed on an end opposing the first hinge and the second hinge, respectively, and the at least one of the first lid and the second lid is placed in the partially closed position to allow the first upper leaf and the first lower leaf to be meshed with a second upper leaf and a second lower leaf.

26. The storage container of claim 25, wherein the first upper leaf and the second upper leaf overlap with the first lower leaf and second lower leaf when the at least one of the first lid and the second lid is in a closed position relative to the wall.

27. The storage container of claim 1, wherein the wall includes a first upward projection and wherein the integrally molded first hinge member is formed in the first upward projection.

28. The storage container of claim 27, wherein the first upward projection has the hinge pin socket formed therein, and wherein the integrally molded second hinge member includes the hinge pin rotatably received in the hinge pin socket.

29. The storage container of claim 9, wherein the lip extends along an outer edge of the lower leaf.

30. The storage container of claim 9, wherein the lip has a constant height between the first upper leaf and the second upper leaf.

31. A storage container comprising:

a base;

a wall extending upwardly from the base;

a lid hingeably connected to the wall; and a document pocket on an upper surface of the lid, the document pocket having a lower surface recessed relative to the upper surface of the lid and a recess formed in a portion of the lower surface of the document pocket, wherein the recess is recessed relative to the lower surface and located adjacent an opening of the document pocket to assist in accessing a document in an interior of the document pocket, wherein the opening is spaced away from the recess of the document pocket.

32. The storage container of claim 31, wherein a tab surrounds a portion of the periphery of the document pocket to retain a document within the document pocket, wherein the opening is proximate to a remainder of the periphery of the document pocket that does not include the tab.

33. The storage container of claim 31, further including a document in the document pocket, wherein an edge of the document within the document pocket in the recessed area is raised relative to the upper surface of the lid when pressure is applied to an upper surface of the document to push into the recess a portion of the document adjacent the edge of the document.

34. The storage container of claim 19, wherein the security feature includes interference between the at least one of the first lid and the second lid and the container that retains the at least one of the first lid and the second lid in the partially closed position, wherein the interference is sufficient to maintain the at least one of the first lid and the second lid in a partially open position but can be overcome upon application of sufficient force on the at least one of the first lid and the second lid.

35. The storage container of claim 1, wherein the integrally molded first hinge member includes the hinge pin socket and the integrally molded second hinge member includes the hinge pin.

36. The storage container of claim 1, wherein the hinge pin is snap fit in the hinge pin socket.

37. The storage container of claim 1, wherein the hinge pin is integral with the integrally molded second hinge member.

38. The storage container of claim 1, including a plurality of integrally molded first hinge members each including two hinge pin sockets and a plurality of integrally molded second hinge members each including two hinge pins.

39. The storage container of claim 1, wherein the integrally molded first hinge member and the one of a hinge pin and a hinge pin socket are a single component, and the integrally molded second hinge member and the other of the hinge pin and the hinge pin socket are a single component.

40. The storage container of claim 12, wherein the at least one first hinge member is integrally molded and includes a hinge pin socket and the plurality of second hinge members are integrally molded and includes a hinge pin.

41. The storage container of claim 40, wherein the hinge pin is snap fit in the hinge pin socket.

42. The storage container of claim 40, wherein hinge pin is integral with the plurality of second hinge members.

43. The storage container of claim 40, wherein the at least one first hinge member and the one of the hinge pin and the hinge pin socket are a single component, and the plurality of second hinge members and the other of the hinge pin and the hinge pin socket are a single component.

44. The storage container of claim 10, wherein the lower leaf is located between the first upper leaf and the second upper leaf of the first lid, and the upper leaf is located between the first lower leaf and the second lower leaf of the second lid.

45. The storage container of claim 44, wherein the first upper leaf, the second upper leaf, and the lower leaf are located in a common plane, and the first lower leaf, the second lower leaf, and the upper leaf are located in another common plane.

46. The storage container of claim 19, wherein the security feature of each of the first lid and the second lid includes an upward projection that contacts a hinge retainer of one of the plurality of walls when the first lid and the second lid is in the partially closed position.

47. The storage container of claim 31, wherein the document pocket includes a single recess.

48. The storage container of claim 31, wherein the document pocket is rectangular and includes four sides, and the portion of the periphery of the document pocket includes three sides of the document pocket.

49. The storage container of claim 31, wherein a tab surrounds less than an entirety of the periphery of the document pocket.

50. The storage container of claim 9, wherein the plurality of protrusions are spaced apart from each other.

51. The storage container of claim 9, wherein the plurality of protrusions comprise a first row of projections and a second row of projections parallel relative to each other and both located on the lower leaf between the lip and the first hinge.

52. The storage container of claim 12, wherein the lip is spaced a first distance from the base and the plurality of second hinge members are located a second distance from the base, and the first distance is less than the second distance.

53. The storage container of claim 5, wherein the first interlocking feature and the second interlocking feature prevent an end of the lid hingeably connected to the wall from moving upwardly from the wall when the lid is in the closed position.

54. The storage container of claim 5, wherein the first interlocking feature is a slot within the wall, the second interlocking feature is a tab protruding from the lid and wherein the tab interlocks with the slot.

55. The storage container of claim 5, wherein a hinge connects the lid to the wall, the hinge including a lip protruding upwardly to prevent water intrusion through the hinge.

56. The storage container of claim 5, wherein the lid has a stop extending upwardly on an opposing end of the lid from the second interlocking feature.

57. The storage container of claim 56, wherein an end wall extends upwardly from an adjacent side of the base, and the end wall has a recess formed on a lower edge and corresponding to a location of the stop.

58. The storage container of claim 5, wherein the wall includes a first upward projection and wherein the integrally molded first hinge member is formed in the first upward projection.

59. The storage container of claim 5, wherein the integrally molded first hinge member includes the hinge pin socket and the integrally molded second hinge member includes the hinge pin.

60. The storage container of claim 5, wherein the hinge pin is snap fit in the hinge pin socket.

61. The storage container of claim 31, wherein a lower surface of the recess is located below the lower surface of the document pocket.

62. The storage container of claim 31, wherein the recess is next to the opening of the document pocket.

63. The storage container of claim 31, wherein the recess is spaced away from an outer perimeter of the document pocket.

64. The storage container of claim 31, wherein the document is located over the recess when received in the document pocket.

* * * * *

UNITED STATES PATENT AND TRADEMARK OFFICE

CERTIFICATE OF CORRECTION

PATENT NO. : 8,066,143 B2
APPLICATION NO. : 11/358695
DATED : November 29, 2011
INVENTOR(S) : Baltz et al.

It is certified that error appears in the above-identified patent and that said Letters Patent is hereby corrected as shown below:

IN THE CLAIMS:

In claim 21, column 7, line 56, please replace “claim 2” with --claim 20--.

Signed and Sealed this
Sixth Day of March, 2012

David J. Kappos

David J. Kappos
*Director of the United States Patent and Trademark Office*